US011592032B2

(12) United States Patent
Teramoto et al.

(10) Patent No.: US 11,592,032 B2
(45) Date of Patent: Feb. 28, 2023

(54) CENTRIFUGAL FAN, AIR-SENDING DEVICE, AIR-CONDITIONING APPARATUS, AND REFRIGERATION CYCLE APPARATUS

(71) Applicant: Mitsubishi Electric Corporation, Tokyo (JP)

(72) Inventors: Takuya Teramoto, Tokyo (JP); Ryo Horie, Tokyo (JP); Takahiro Yamatani, Tokyo (JP); Kazuya Michikami, Tokyo (JP); Hiroshi Tsutsumi, Tokyo (JP); Hiroyasu Hayashi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 232 days.

(21) Appl. No.: 16/755,732

(22) PCT Filed: Oct. 31, 2017

(86) PCT No.: PCT/JP2017/039332
§ 371 (c)(1),
(2) Date: Apr. 13, 2020

(87) PCT Pub. No.: WO2019/087298
PCT Pub. Date: May 9, 2019

(65) Prior Publication Data

US 2021/0199125 A1 Jul. 1, 2021

(51) Int. Cl.
*F04D 29/42* (2006.01)
*F04D 29/58* (2006.01)
(Continued)

(52) U.S. Cl.
CPC ..... *F04D 29/4233* (2013.01); *F04D 29/5826* (2013.01); *F25D 17/067* (2013.01);
(Continued)

(58) Field of Classification Search
CPC ..... F04D 29/4226; F04D 29/4233; F04D 29/5826; F04D 25/08; F04D 29/40;
(Continued)

(56) References Cited

U.S. PATENT DOCUMENTS 4,913,621 A * 4/1990 Reither ..... F04D 29/4226 415/211.1
5,570,996 A * 11/1996 Smiley, III ..... F04D 29/4226 415/53.2
(Continued)

FOREIGN PATENT DOCUMENTS

CN 106468280 A 3/2017
EP 2 128 451 A1 12/2009
(Continued)

OTHER PUBLICATIONS

JPS5870498 translation (Year: 2022).*
(Continued)

*Primary Examiner* — Kenneth J Hansen
*Assistant Examiner* — David N Brandt
(74) *Attorney, Agent, or Firm* — Posz Law Group, PLC

(57) ABSTRACT

A centrifugal fan includes: a fan, blades; and a scroll casing housing the fan, the scroll casing including a discharge portion, and a scroll portion including a side wall, a circumferential wall, and a tongue portion. In the circumferential wall, at a first end between the circumferential wall and the tongue portion, and at a second end between the circumferential wall and the discharge portion, a distance between an axis of the rotational shaft and the circumferential wall is equal to a distance between the axis of the rotational shaft and a standard circumferential wall, and is greater than or equal to the distance between the first end and the second end of the circumferential wall, the circumferential wall
(Continued)

including a plurality of extended portions between the first end and the second end of the circumferential wall.

11 Claims, 12 Drawing Sheets

(51) Int. Cl.

| | |
|---|---|
| ***F25D 17/06*** | (2006.01) |
| ***F04D 25/08*** | (2006.01) |
| ***F04D 29/40*** | (2006.01) |
| ***F04D 29/66*** | (2006.01) |

(52) U.S. Cl.
CPC ..... *F04D 25/08* (2013.01); *F04D 29/403* (2013.01); *F04D 29/42* (2013.01); *F04D 29/422* (2013.01); *F04D 29/424* (2013.01); *F04D 29/663* (2013.01); *F04D 29/667* (2013.01); *F05D 2250/52* (2013.01); *F05D 2250/70* (2013.01); *F25D 17/06* (2013.01)

(58) Field of Classification Search
CPC .... F04D 29/403; F04D 29/42; F04D 29/4206; F04D 29/422; F04D 29/424; F04D 29/663; F04D 29/667; F04D 29/441; F25D 17/067; F25D 17/06; F05D 2250/52; F05D 2250/70
See application file for complete search history.

(56) References Cited

U.S. PATENT DOCUMENTS

| | | | | |
|---|---|---|---|---|
| 7,604,043 | B2 * | 10/2009 | Higashida | F24F 1/0033 165/122 |
| 2004/0253092 | A1 * | 12/2004 | Hancock | F04D 29/441 415/1 |
| 2015/0016979 | A1 | 1/2015 | Park et al. | |
| 2017/0051749 | A1 | 2/2017 | Cho et al. | |

FOREIGN PATENT DOCUMENTS

| | | | | |
|---|---|---|---|---|
| JP | S5870498 | * | 1/1983 | F04D 29/44 |
| JP | S58-070498 | U | 5/1983 | |
| JP | 2010-216294 | A | 9/2010 | |
| JP | 4906555 | B2 | 3/2012 | |
| JP | 2016-033338 | A | 3/2016 | |
| JP | 2016-061278 | A | 4/2016 | |

OTHER PUBLICATIONS

Office Action dated Oct. 13, 2021 issued in corresponding CN patent application No. 201780096135.4 (and English Machine Translation).
Indian Examination Report dated Feb. 23, 2021, issued in corresponding Indian Patent Application No. 202027015969 (and English Machine Translation).
Japanese Office Action dated Mar. 16, 2021, issued in corresponding Japanese Patent Application No. 2019-550048 (and English Machine Translation).
Examination Report dated Feb. 1, 2021 issued in corresponding AU patent application No. 2017438454.
International Search Report of the International Searching Authority dated Jan. 23, 2018 for the corresponding international application No. PCT/JP2017/039332 (and English translation).
Office Action dated Sep. 11, 2020 issued on corresponding CN patent application No. 201780096135.4 (and English translation).
Extended European Search Report dated Sep. 22, 2020 issued on corresponding EP application No. 17930970.3.
Office Action dated May 31, 2021, issued in corresponding CN Patent Application No. 201780096135.4 (and English Machine Translation).
Office Action dated Aug. 20, 2021 issued in corresponding Indonesian patent application No. P00202003016 (and English translation).
Office Action dated Jan. 3, 2022 issued in corresponding European patent application No. 17930970.3.
Office Action dated Nov. 15, 2022 issued in corresponding Japanese patent application No. 2021-166710 (and English translation).

* cited by examiner

CENTRIFUGAL FAN, AIR-SENDING DEVICE, AIR-CONDITIONING APPARATUS, AND REFRIGERATION CYCLE APPARATUS

CROSS REFERENCE TO RELATED APPLICATION

This application is a U.S. national stage application of PCT/JP2017/039332 filed on Oct. 31, 2017, the contents of which are incorporated herein by reference.

TECHNICAL FIELD

The present disclosure relates to a centrifugal fan including a scroll casing, and an air-sending device, an air-conditioning apparatus, and a refrigeration cycle apparatus including the centrifugal fan.

BACKGROUND ART

Some centrifugal fans of the related art include a circumferential wall provided in a logarithmic spiral shape in which the distance between an axis of a fan and a circumferential wall of a scroll casing is sequentially extended from the downstream side to the upstream side of the air flow flowing in the scroll casing. In such a centrifugal fan, when the extension rate of the distance between the axis of the fan and the circumferential wall of the scroll casing is not sufficiently large in the direction of the air flow in the scroll casing, not only does the pressure recovery from the dynamic pressure to the static pressure is insufficient and the air-sending efficiency decreases, but the loss also increases and the noise also worsens. Thus, a centrifugal fan including an external form formed in a spiral shape and two substantially-parallel linear portions provided on the external form is proposed (for example, see Patent Literature 1). In the centrifugal fan, one linear portion out of the linear portions is connected to a discharge port in a scroll, and a rotational shaft of a motor is located near the linear portion close to a tongue portion of the scroll. Since a sirocco fan in Patent Literature 1 includes the above-mentioned configuration, a reverse flow phenomenon can be suppressed and the noise value can be reduced while maintaining a predetermined air volume.

CITATION LIST

Patent Literature

Patent Literature 1: Japanese Patent No. 4906555

SUMMARY OF INVENTION

Technical Problem

However, in the centrifugal fan in Patent Literature 1, which can improve the noise problem, may suffer from a decrease in the air-sending efficiency because of insufficient pressure recovery from the dynamic pressure to the static pressure when the extension rate of the circumferential wall of the scroll casing to a predetermined direction cannot be sufficiently secured due to a restriction in the external dimensions depending on the place of installation.

An object of the present disclosure, which has been made to solve the above-mentioned problems, is to obtain a centrifugal fan, an air-sending device, an air-conditioning apparatus, and a refrigeration cycle apparatus configured to reduce noise and improve the air-sending efficiency.

Solution to Problem

According to an embodiment of the present disclosure, there is provided a centrifugal fan comprising: a fan including a main plate having a disk-shape, and a plurality of blades installed on a circumferential portion of the main plate; and a scroll casing configured to house the fan, the scroll casing including a discharge portion forming a discharge port from which an air flow generated by the fan is discharged, and a scroll portion including a side wall covering the fan in an axis direction of a rotational shaft of the fan, and formed with a suction port configured to suction air, a circumferential wall encircling the fan in a radial direction of the rotational shaft, and a tongue portion provided between the discharge portion and the circumferential wall, and configured to guide the air flow generated by the fan to the discharge port. In comparison with a centrifugal fan including a standard circumferential wall having a logarithmic spiral shape in cross-section perpendicular to the rotational shaft of the fan, in the circumferential wall, at a first end being a boundary between the circumferential wall and the tongue portion and at a second end being a boundary between the circumferential wall and the discharge portion, a distance L1 between an axis of the rotational shaft and the circumferential wall is equal to a distance L2 between the axis of the rotational shaft and the standard circumferential wall, the distance L1 is greater than or equal to the distance L2 between the first end and the second end of the circumferential wall, the circumferential wall includes a plurality of extended portions between the first end and the second end of the circumferential wall, and the plurality of extended portions include maximum points each have a length being a difference LH between the distance L1 and the distance L2.

Advantageous Effects of Disclosure

In the centrifugal fan according to an embodiment of the present disclosure, in comparison with the centrifugal fan including the standard circumferential wall having a logarithmic spiral shape in cross-section perpendicular to the rotational shaft of the fan, in the circumferential wall, at the first end and at the second end, the distance L1 is equal to the distance L2. In the circumferential wall, between the first end and the second end of the circumferential wall, the distance L1 is greater than or equal to the distance L2. The circumferential wall includes the plurality of extended portions between the first end and the second end of the circumferential wall, and the plurality of extended portions include maximum points each having a length being a difference LH between the distance L1 and the distance L2. Therefore, in the centrifugal fan, even when the extension rate of the circumferential wall of the scroll casing to a predetermined direction cannot be sufficiently secured due to the restriction in the external dimensions depending on the place of installation, the distance of an air passage in which the distance between the axis of the rotational shaft and the circumferential wall is extended can be increased because the circumferential wall includes the configuration above in the extendable direction. As a result, the centrifugal fan can convert the dynamic pressure to the static pressure by reducing the speed of the air flow flowing in the scroll casing while preventing the separation of the air flow, and hence can improve the air-sending efficiency while reducing the noise.

DESCRIPTION OF EMBODIMENTS

Figure 1:
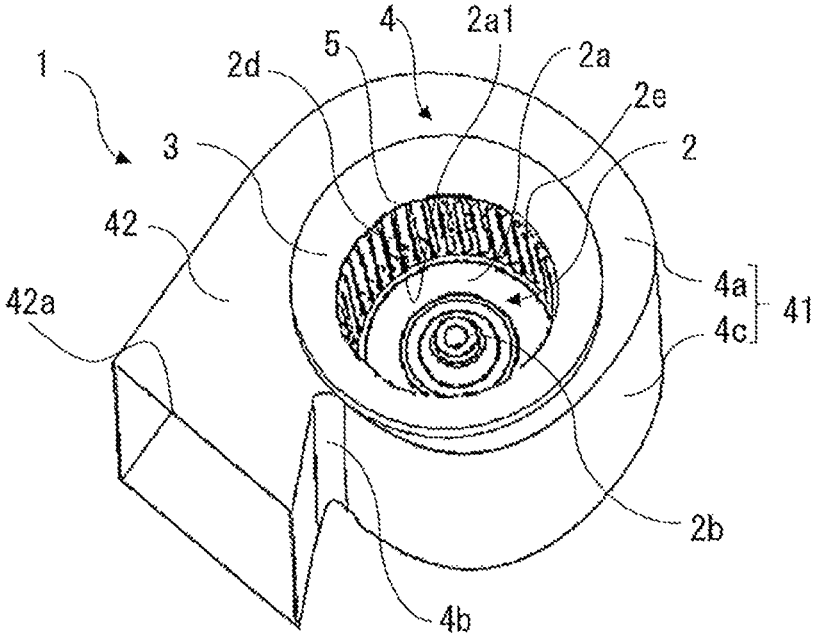
FIG. 1 is a perspective view of a centrifugal fan according to Embodiment 1 of the present disclosure.

A centrifugal fan 1, an air-sending device 30, an air-conditioning apparatus 40, and a refrigeration cycle apparatus 50 according to embodiments of the present disclosure are described below with reference to the drawings, for example. Note that, in the drawings below including FIG. 1, the relationships between relative dimensions, shapes and other features of configuration parts may differ from actual ones. In the drawings below, parts denoted by the same reference characters are the same parts or parts equivalent thereto, and the above is common throughout the entire description. Terms (for example, "up", "down", "right", "left", "front", and "rear") indicating directions are used, as appropriate, for facilitating understanding, but those expressions are described as above for the sake of convenience, and the arrangement and the orientations of the devices or the parts are not limited thereby.

Embodiment 1

[Centrifugal Fan 1]

Figure 2:
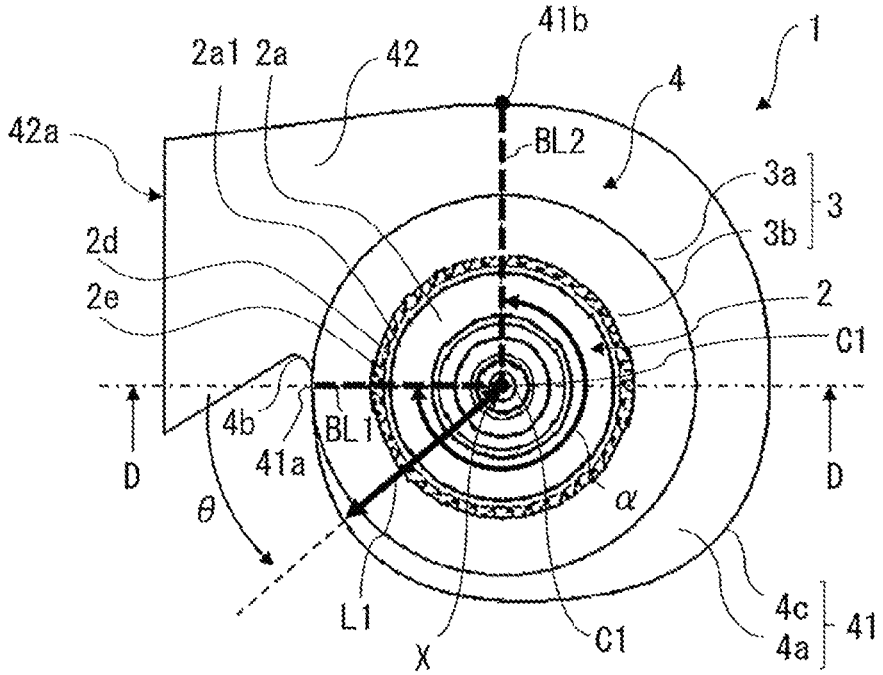
FIG. 2 is a top view of the centrifugal fan according to Embodiment 1 of the present disclosure.
Figure 3:
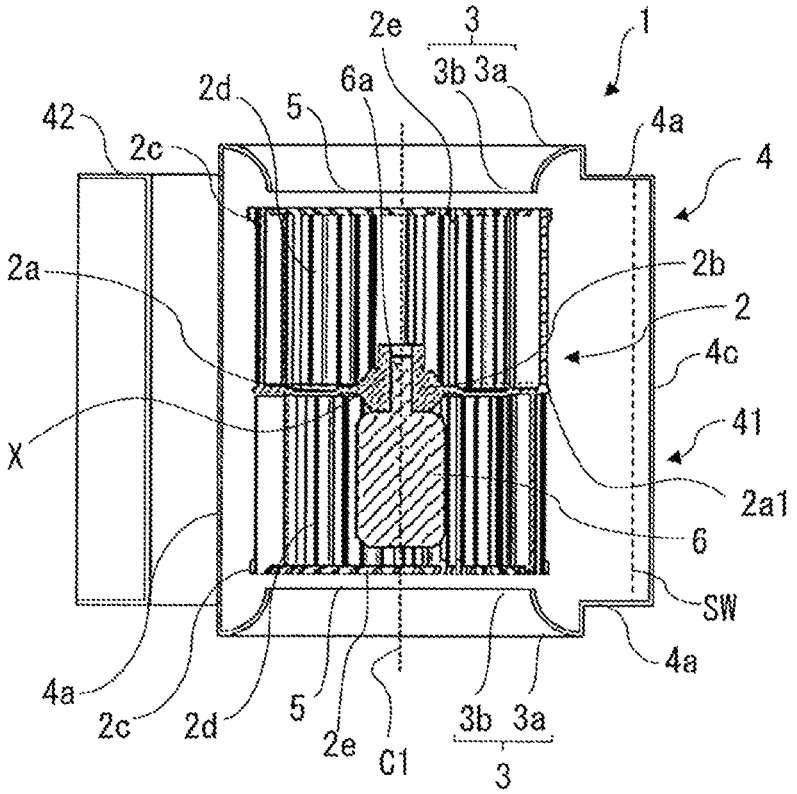
FIG. 3 is a cross-sectional view of the centrifugal fan in FIG. 2 taken along line D-D.

FIG. 1 is a perspective view of a centrifugal fan 1 according to Embodiment 1 of the present disclosure. FIG. 2 is a top view of the centrifugal fan 1 according to Embodiment 1 of the present disclosure. FIG. 3 is a cross-sectional view of the centrifugal fan 1 in FIG. 2 taken along line D-D. A basic structure of the centrifugal fan 1 is described with reference to FIG. 1 to FIG. 3. Note that the dotted line shown in FIG. 3 is a standard circumferential wall SW in cross-section showing a circumferential wall of a centrifugal fan of the related art. The centrifugal fan 1 is a multi-wing centrifugal-type centrifugal fan, and includes a fan 2 configured to generate air flow, and a scroll casing 4 configured to house the fan 2.

(Fan 2)

The fan 2 includes a main plate 2*a* having a disk-shape, and a plurality of blades 2*d* installed on a circumferential portion 2*a*1 of the main plate 2*a*. The fan 2 includes ring-shaped side plates 2*c* facing the main plate 2*a*. The ring-shaped side plates 2*c* are placed on ends of the fan 2 opposite to the main plate 2*a* of the plurality of blades 2*d*. Note that the fan 2 may have a structure not including the side plates 2*c*. When the fan 2 includes the side plates 2*c*, the plurality of blades 2*d* each have one end being connected to the main plate 2*a* and the other end being connected to each of the side plates 2*c*, and the plurality of blades 2*d* are disposed between the main plate 2*a* and the side plates 2*c*. A boss portion 2*b* is provided on the center portion of the main plate 2*a*. An output shaft 6*a* of a fan motor 6 is connected to the center of the boss portion 2*b*, and the fan 2 rotates by a driving force of the fan motor 6. The fan 2 forms a rotational shaft X by the boss portion 2*b* and the output shaft 6*a*. The plurality of blades 2*d* encircle the rotational shaft X of the fan 2 between the main plate 2*a* and the side plates 2*c*. The fan 2 is formed in a cylindrical shape by the main plate 2*a* and the plurality of blades 2*d*, and suction ports 2*e* are formed on side plate 2*c* sides opposite to the main plate 2*a* in the axis direction of the rotational shaft X of the fan 2. As shown in FIG. 3, the fan 2 has the plurality of blades 2*d* provided on both sides of the main plate 2*a* in the axis direction of the rotational shaft X. Note that the configuration of the fan 2 is not limited to a configuration in which the plurality of blades 2*d* are provided on both sides of the main plate 2*a* in the axis direction of the rotational shaft X, and the plurality of blades 2*d* may be provided on only one side of the main plate 2*a* in the axis direction of the rotational shaft X, for example. As shown in FIG. 3, in the fan 2, the fan motor 6 is disposed on an inner peripheral side of the fan 2, but the output shaft 6*a* only needs to be connected to the boss portion 2*b* in the fan 2, and the fan motor 6 may be disposed outside of the centrifugal fan 1.

(Scroll Casing 4)

The scroll casing 4 encircles the fan 2, and rectifies the air blown out from the fan 2. The scroll casing 4 includes a discharge portion 42 configured to form a discharge port 42*a* from which the air flow generated by the fan 2 is discharged, and a scroll portion 41 configured to form an air passage configured to convert the dynamic pressure of the air flow generated by the fan 2 to the static pressure. The discharge portion 42 forms the discharge port 42*a* from which the air flow passing through the scroll portion 41 is discharged. The scroll portion 41 includes side walls 4*a* covering the fan 2 in the axis direction of the rotational shaft X of the fan 2 and formed with suction ports 5 configured to suction air, and a circumferential wall 4*c* encircling the fan 2 in the radial direction of the rotational shaft X. The scroll portion 41 includes a tongue portion 4*b* provided between the discharge portion 42 and the circumferential wall 4*c* and configured to guide the air flow generated by the fan 2 to the discharge port 42*a* via the scroll portion 41. Note that the radial direction of the rotational shaft X is a direction perpendicular to the rotational shaft X. An inner space in the scroll portion 41 made of the circumferential wall 4*c* and the side walls 4*a* is a space in which the air blown out from the fan 2 flows along the circumferential wall 4*c*.

(Side Walls 4*a*)

The suction ports 5 are formed in the side walls 4*a* of the scroll casing 4. On the side walls 4*a*, bell mouths 3 configured to guide the air flow suctioned into the scroll casing 4 through the suction ports 5, are provided. The bell mouths 3 are formed in positions facing the suction ports 2*e* of the fan 2. Each of the bell mouths 3 has a shape in which the air passage narrows from an upstream end 3*a* being an end on the upstream side of the air flow suctioned into the scroll casing 4 through the suction ports 5, toward a downstream end 3*b* being an end on the downstream side. As shown in FIG. 1 to FIG. 3, the centrifugal fan 1 includes a double-suction scroll casing 4 including the side walls 4*a* in which the suction ports 5 are formed on both sides of the main plate 2*a* in the axis direction of the rotational shaft X. Note that the centrifugal fan 1 is not limited to a configuration including the double-suction scroll casing 4, and may include the single-suction scroll casing 4 including the side wall 4*a* in which the suction port 5 is formed on one side of the main plate 2*a* in the axis direction of the rotational shaft X.

(Circumferential Wall 4*c*)

The circumferential wall 4*c* encircles the fan 2 in the radial direction of the rotational shaft X, and forms an inner peripheral surface facing the plurality of blades 2*d* forming an outer peripheral surface of the fan 2 in the radial direction. The circumferential wall 4*c* has a width in the axis direction of the rotational shaft X, and is formed in a spiral shape in top view. As shown in FIG. 2, the circumferential wall 4*c* is provided in a portion from a first end 41*a* positioned in the boundary between the scroll portion 41 and the tongue portion 4*b* to a second end 41*b* positioned in the boundary between the discharge portion 42 and the scroll portion 41 on the side far from the tongue portion 4*b* along the direction of rotation of the fan 2. The inner peripheral surface of the circumferential wall 4*c* forms a curved surface smoothly forming a curve from the first end 41*a* being the start of the winding of the spiral shape to the second end 41*b* being the end of the winding of the spiral shape along the circumferential direction of the fan 2. The first end 41*a* is an edge portion on the upstream side of the air flow generated by the rotation of the fan 2, and the second end 41*b* is an edge portion on the downstream side of the air flow generated by the rotation of the fan 2 in the circumferential wall 4*c* forming the curved surface.

An angle θ shown in FIG. 2 is an angle shifted from a first reference line BL in the direction of rotation of the fan 2 between a first reference line BL1 connecting an axis C1 of the rotational shaft X and the first end 41*a* to each other and a second reference line BL2 connecting the axis C1 of the rotational shaft X and the second end 41*b* to each other in cross-section perpendicular to the rotational shaft X of the fan 2. The angle θ of the first reference line BL1 shown in FIG. 2 is 0 degrees. Note that the angle of the second reference line BL2 is an angle α, and does not indicate a predetermined value. This is because the angle α of the second reference line BL2 differs depending on the spiral shape of the scroll casing 4, and the spiral shape of the scroll casing 4 is defined by the opening port diameter of the discharge port 42*a*, for example. The angle α of the second reference line BL2 is specifically determined by the opening port diameter of the discharge port 42*a* needed depending on the purpose of the centrifugal fan 1, for example. Therefore, in the centrifugal fan 1 of Embodiment 1, the angle α is described to be 270 degrees, but it may be 300 degrees or other angles depending on the opening port diameter of the discharge port 42*a*, for example. Similarly, the position of the standard circumferential wall SW having a logarithmic spiral shape is determined by the opening port diameter of the discharge port 42*a* of the discharge portion 42 in the direction perpendicular to the rotational shaft X.

Figure 4:
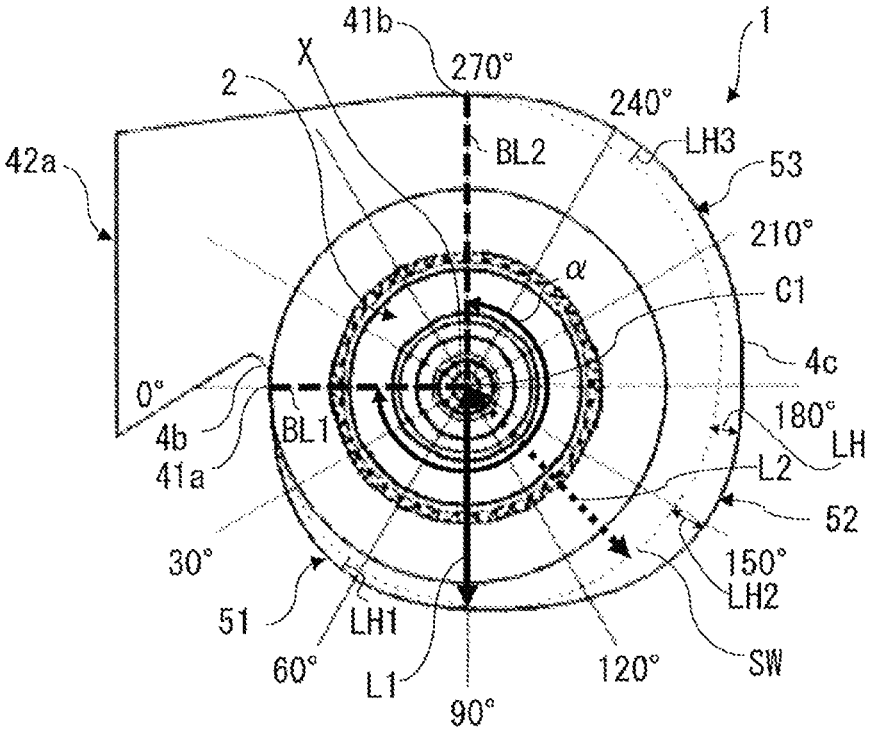
FIG. 4 is a top view illustrating a comparison between a circumferential wall of the centrifugal fan according to Embodiment 1 of the present disclosure and a standard circumferential wall of a centrifugal fan of the related art having a logarithmic spiral shape.
Figure 5:
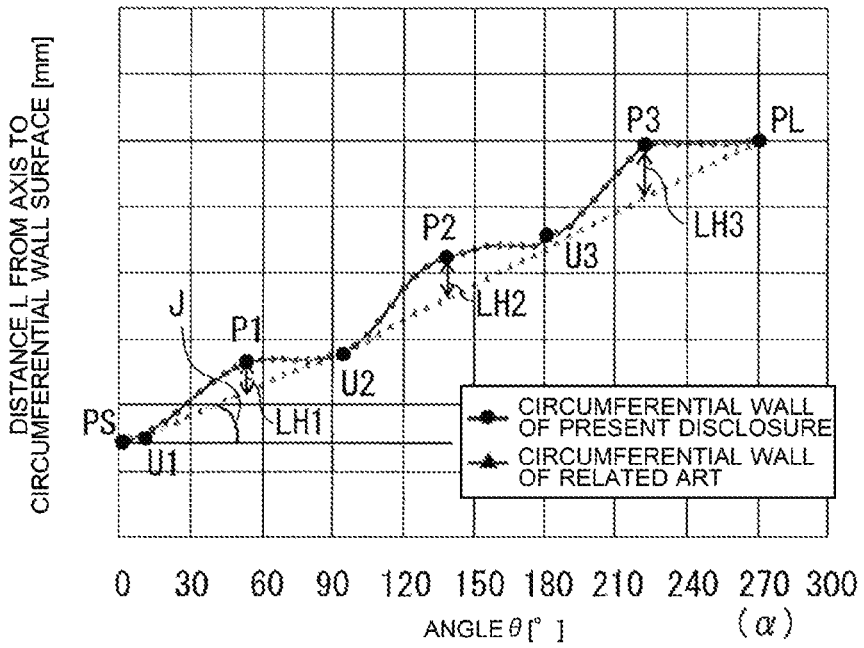
FIG. 5 shows the relationship between an angle θ [degree] and a distance L [mm] from an axis to a circumferential wall surface in the centrifugal fan 1 or the centrifugal fan of the related art in FIG. 4.

FIG. 4 is a top view illustrating the comparison between the circumferential wall 4*c* of the centrifugal fan 1 according to Embodiment 1 of the present disclosure and the standard circumferential wall SW of the centrifugal fan of the related art having a logarithmic spiral shape. FIG. 5 shows the relationship between the angle θ [degree] and the distance L [mm] from the axis to the circumferential wall surface in the centrifugal fan 1 or the centrifugal fan of the related art in FIG. 4. In FIG. 5, the solid line connecting the circles shows the circumferential wall 4*c*, and the broken line connecting the triangles shows the standard circumferential wall SW. The circumferential wall 4*c* is further described in detail by comparing the centrifugal fan 1 with the centrifugal fan including the standard circumferential wall SW having a logarithmic spiral shape in cross-section perpendicular to the rotational shaft X of the fan 2. The standard circumferential wall SW of the centrifugal fan of the related art shown in FIG. 4 and FIG. 5 forms a curved surface having a spiral shape defined by a predetermined extension rate (predetermined extension rate). Examples of the standard circumferential wall SW having a spiral shape defined by the predetermined extension rate include a standard circumferential wall SW obtained by a logarithmic spiral, a standard circumferential wall SW obtained by an Archimedes' screw, and a standard circumferential wall SW obtained by the involute curve. In a specific example of the centrifugal fan of the related art shown in FIG. 4, the standard circumferential wall SW is defined by a logarithmic spiral, but the standard circumferential wall SW obtained by an Archimedes' screw or the standard circumferential wall SW obtained by an involute curve may be the standard circumferential wall SW of the centrifugal fan of the related art. As shown in FIG. 5, in the circumferential wall having a logarithmic spiral shape forming the centrifugal fan of the related art, an extension rate J defining the standard circumferential wall SW is an angle of the inclination of a graph in which the horizontal axis shows the angle θ being a winding angle, and the vertical axis shows the distance between the axis C1 of the rotational shaft X and the standard circumferential wall SW.

In FIG. 5, a point PS is the position of the first end 41*a* in the circumferential wall 4*c* and is a radius of the standard circumferential wall SW of the centrifugal fan of the related art. In FIG. 5, a point PL is the position of the second end 41*b* in the circumferential wall 4*c* and is the radius of the standard circumferential wall SW of the centrifugal fan of the related art. As shown in FIG. 4 and FIG. 5, in the circumferential wall 4*c*, at the first end 41*a* being the boundary between the circumferential wall 4*c* and the tongue portion 4*b*, the distance L1 between the axis C1 of the rotational shaft X and the circumferential wall 4*c* is equal to the distance L2 between the axis C1 of the rotational shaft X and the standard circumferential wall SW. In the circumferential wall 4*c*, at the second end 41*b* being the boundary between the circumferential wall 4*c* and the discharge portion 42, the distance L1 between the axis C1 of the rotational shaft X and the circumferential wall 4*c* is equal to the distance L2 between the axis C1 of the rotational shaft X and the standard circumferential wall SW.

As shown in FIG. 4 and FIG. 5, in the circumferential wall 4*c*, between the first end 41*a* and the second end 41*b* of the circumferential wall 4*c*, the distance L1 between the axis C1 of the rotational shaft X and the circumferential wall 4*c* is greater than or equal to the distance L2 between the axis C1 of the rotational shaft X and the standard circumferential wall SW. The circumferential wall 4*c* includes three extended portions between the first end 41*a* and the second end 41*b* of the circumferential wall 4*c*. The three extended portions include maximum points each having a length being the difference LH between the distance L1 between the axis C1 of the rotational shaft X and the circumferential wall 4*c* and the distance L2 between the axis C1 of the rotational shaft X and the standard circumferential wall SW.

As shown in FIG. 4, the circumferential wall 4*c* includes a first extended portion 51 bulging out to the radially outer side of the standard circumferential wall SW having a logarithmic spiral shape in a section in which the angle θ is 0 degrees or more and less than 90 degrees. As shown in FIG. 5, the first extended portion 51 includes a first maximum point P1 in a section in which the angle θ is 0 degrees or more and less than 90 degrees. As shown in FIG. 5, the first maximum point P1 is a position in the circumferential wall 4*c* at which the length of the difference LH1 between the distance L1 between the axis C1 of the rotational shaft X and the circumferential wall 4*c* and the distance L2 between the axis C1 of the rotational shaft X and the standard circumferential wall SW is the greatest in a section in which the angle θ is 0 degrees or more and less than 90 degrees. As shown in FIG. 4, the circumferential wall 4*c* includes a second extended portion 52 bulging out to the radially outer side of the standard circumferential wall SW having a logarithmic spiral shape in a section in which the angle θ is 90 degrees or more and less than 180 degrees. As shown in FIG. 5, the second extended portion 52 includes a second maximum point P2 in a section in which the angle θ is 90 degrees or more and less than 180 degrees. As shown in FIG. 5, the second maximum point P2 is a position in the circumferential wall 4*c* at which the length of a difference LH2 between the distance L1 between the axis C1 of the rotational shaft X and the circumferential wall 4*c* and the distance L2 between the axis C1 of the rotational shaft X and the standard circumferential wall SW is the greatest in a section in which the angle θ is 90 degrees or more and less than 180 degrees. As shown in FIG. 4, the circumferential wall 4*c* includes a third extended portion 53 bulging out to the radially outer side of the standard circumferential wall SW having a logarithmic spiral shape in a section in which the angle θ is 180 degrees or more and less than the angle α formed by the second reference line. As shown in FIG. 5, the third extended portion 53 includes a third maximum point P3 in a section in which the angle θ is 180 degrees or more and less than the angle α formed by the second reference line. As shown in FIG. 5, the third maximum point P3 is a position in the circumferential wall 4*c* at which the length of a difference LH3 between the distance L1 between the axis C1 of the rotational shaft X and the circumferential wall 4*c* and the distance L2 between the axis C1 of the rotational shaft X and the standard circumferential wall SW is the greatest in a section in which the angle θ is 180 degrees or more and less than the angle α.

Figure 6:
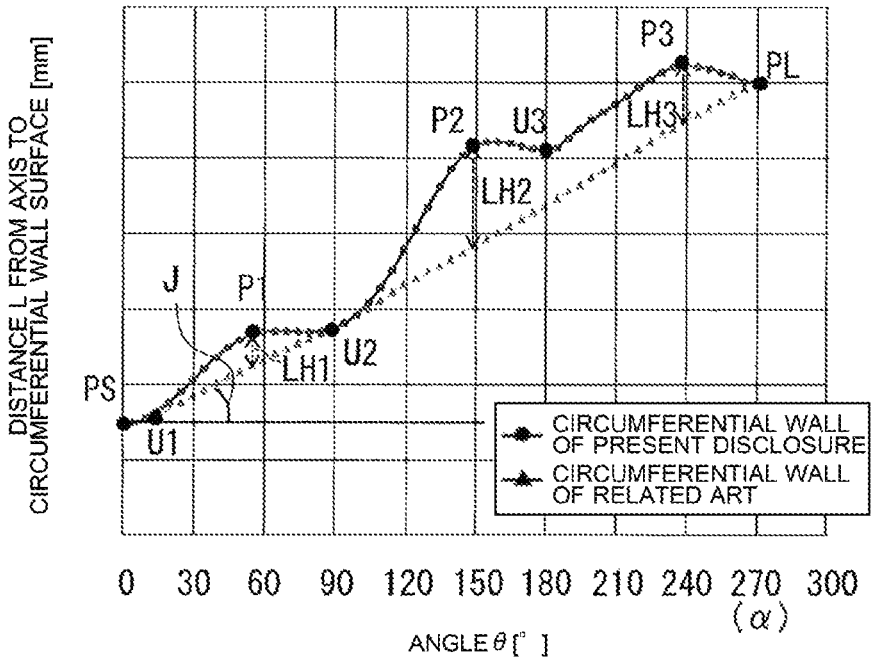
FIG. 6 is a graph obtained by changing extension rates of extended portions in the circumferential wall of the centrifugal fan according to Embodiment 1 of the present disclosure.
Figure 7:
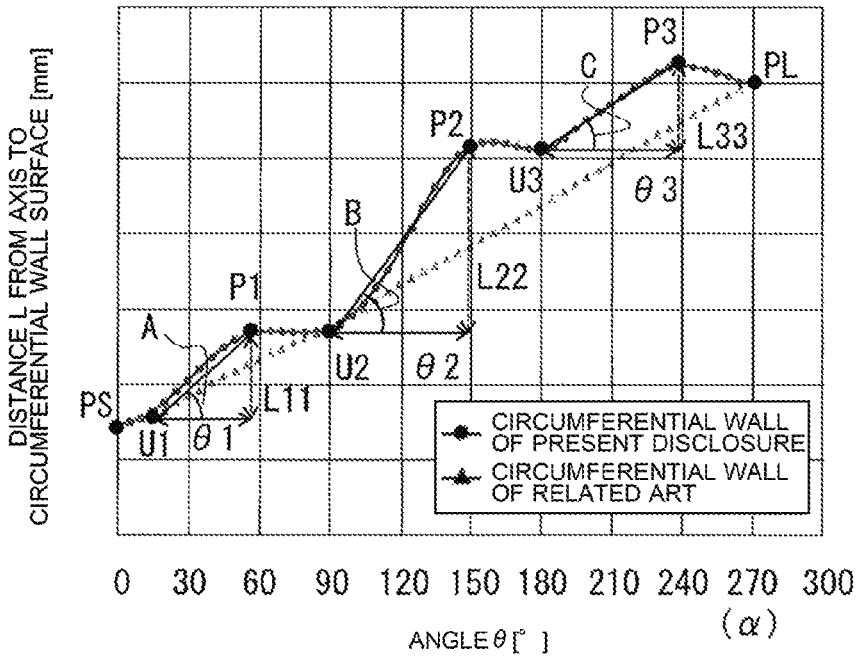
FIG. 7 shows the differences between the extension rates of the extended portions in the circumferential wall of the centrifugal fan according to Embodiment 1 of the present disclosure.

FIG. 6 is a graph obtained by changing the extension rates of the extended portions in the circumferential wall 4*c* of the centrifugal fan 1 according to Embodiment 1 of the present disclosure. FIG. 7 shows the differences between the extension rates of the extended portions in the circumferential wall 4*c* of the centrifugal fan 1 according to Embodiment 1 of the present disclosure. As shown in FIG. 6, the point at which the difference LH is the smallest in a section in which the angle θ is 0 degrees or more and equal to or less than an angle at which the first maximum point P1 is positioned is a first minimum point U1. The point at which the difference LH is the smallest in a section in which the angle θ is 90 degrees or more and equal to or less than an angle at which the second maximum point P2 is positioned is a second minimum point U2. The point at which the difference LH is the smallest in a section in which the angle θ is 180 degrees or more and equal to or less than an angle at which the third maximum point P3 is positioned is a third minimum point U3. In the cases mentioned above, as shown in FIG. 7, a difference L11 between the distance L1 at the first maximum point P1 and the distance L1 at the first minimum point U1 relative to an increase θ1 of the angle θ from the first minimum point U1 to the first maximum point P1 is an extension rate A. A difference L22 between the distance L1 at the second maximum point P2 and the distance L1 at the second minimum point U2 relative to an increase θ2 of the angle θ from the second minimum point U2 to the second maximum point P2 is an extension rate B. A difference L33 between the distance L1 at the third maximum point P3 and the distance L1 at the third minimum point U3 relative to an increase θ3 of the angle θ from the third minimum point U3 to the third maximum point P3 is an extension rate C. At this time, the circumferential wall 4*c* of the centrifugal fan 1 satisfies a relationship of the extension rate B>the extension rate C, and the extension rate B≥the extension rate A>the extension rate C, or a relationship of the extension rate B>the extension rate C, and the extension rate B>the extension rate C≥the extension rate A.

Figure 8:
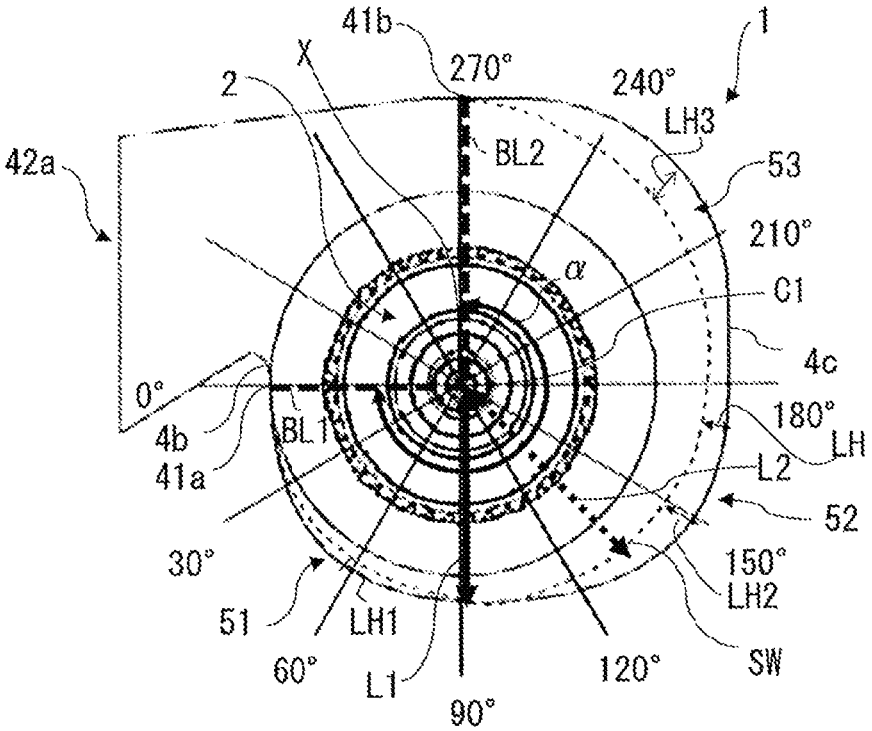
FIG. 8 is a top view illustrating a comparison between a circumferential wall of the centrifugal fan according to Embodiment 1 of the present disclosure having other extension rates and the standard circumferential wall SW of the centrifugal fan of the related art having a logarithmic spiral shape.
Figure 9:
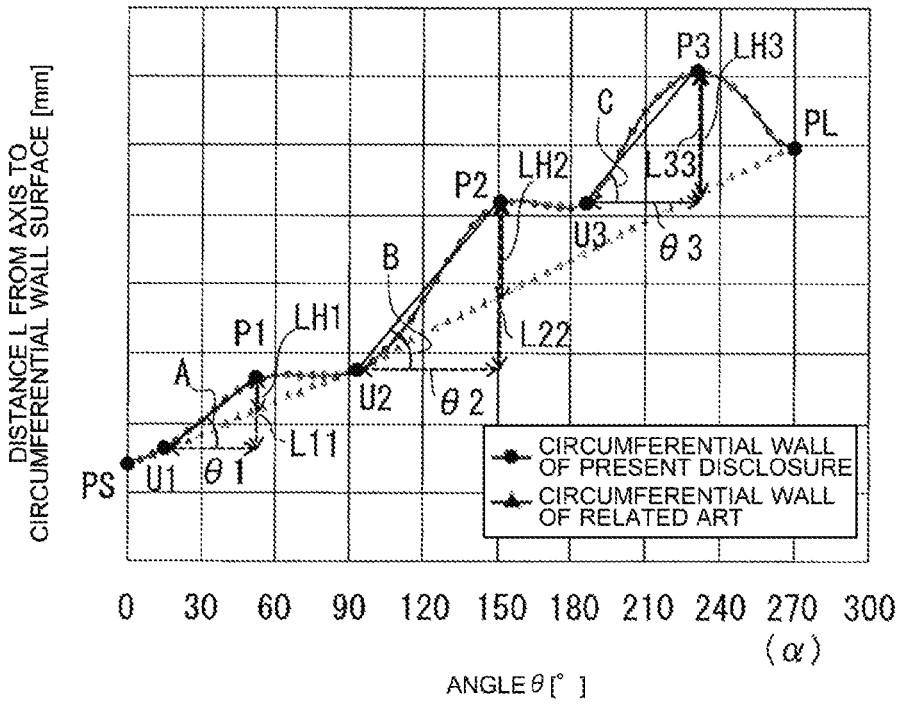
FIG. 9 is a graph obtained by changing the other extension rates of the extended portions in the circumferential wall of the centrifugal fan in FIG. 8.

FIG. 8 is a top view illustrating a comparison between the circumferential wall 4*c* of the centrifugal fan 1 according to Embodiment 1 of the present disclosure having other extension rates, and the standard circumferential wall SW of the centrifugal fan of the related art having a logarithmic spiral shape. FIG. 9 is a graph obtained by changing the other extension rates of the extended portions in the circumferential wall 4*c* of the centrifugal fan 1 in FIG. 8. As shown in FIG. 9, the point at which the difference LH is the smallest in a section in which the angle θ is 0 degrees or more and equal to or less than an angle at which the first maximum point P1 is positioned is the first minimum point U1. The point at which the difference LH is the smallest in a section in which the angle θ is 90 degrees or more and equal to or less than an angle at which the second maximum point P2 is positioned is the second minimum point U2. The point at which the difference LH is the smallest in a section in which the angle θ is 180 degrees or more and equal to or less than an angle at which the third maximum point P3 is positioned is the third minimum point U3. In the cases above, as shown in FIG. 9, the difference L11 between the distance L1 at the first maximum point P1 and the distance L1 at the first minimum point U1 relative to the increase θ1 of the angle θ from the first minimum point U1 to the first maximum point P1 is the extension rate A. The difference L22 between the distance L1 at the second maximum point P2 and the distance L1 at the second minimum point U2 relative to the increase θ2 of the angle θ from the second minimum point U2 to the second maximum point P2 is the extension rate B. The difference L33 between the distance L1 at the third maximum point P3 and the distance L1 at the third minimum point U3 relative to the increase θ3 of the angle θ from the third minimum point U3 to the third maximum point P3 is the extension rate C. At this time, the circumferential wall 4*c* of the centrifugal fan 1 satisfies a relationship of the extension rate C>the extension rate B≥the extension rate A.

Figure 10:
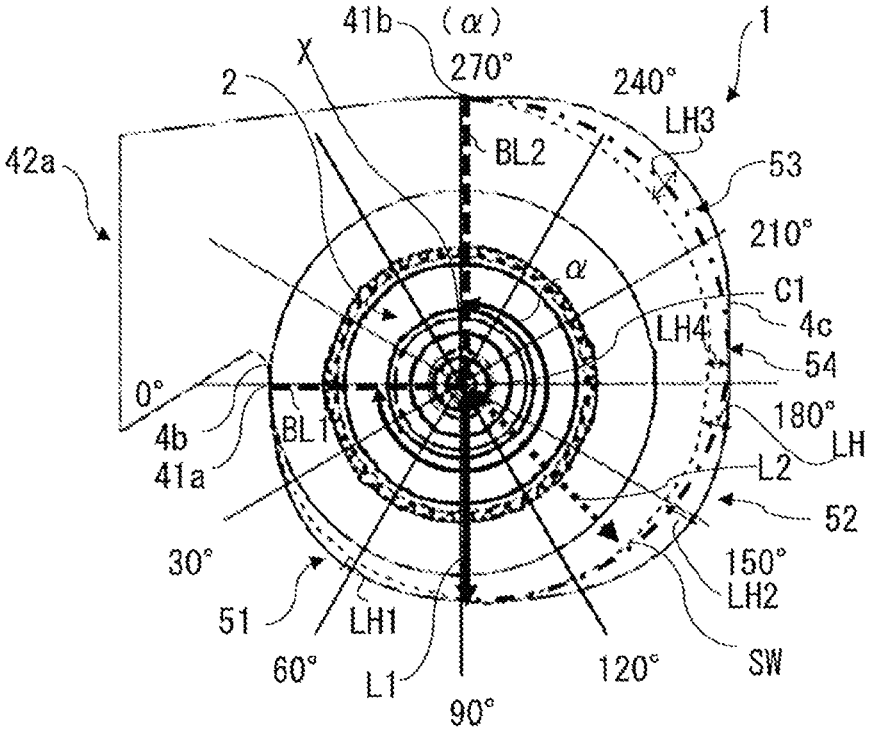
FIG. 10 is a top view illustrating a comparison between a circumferential wall of the centrifugal fan according to Embodiment 1 of the present disclosure having other extension rates, and the standard circumferential wall SW of the centrifugal fan of the related art having a logarithmic spiral shape.
Figure 11:
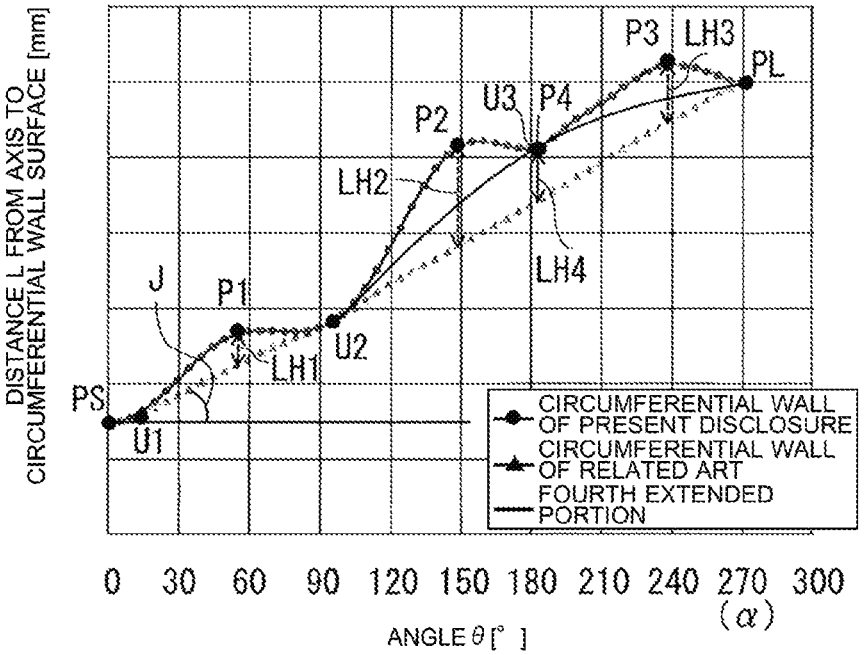
FIG. 11 is a graph obtained by changing the other extension rates of the extended portions in the circumferential wall of the centrifugal fan in FIG. 10.

FIG. 10 is a top view illustrating a comparison between the circumferential wall 4*c* of the centrifugal fan 1 according to Embodiment 1 of the present disclosure having other extension rates and the standard circumferential wall SW of the centrifugal fan of the related art having a logarithmic spiral shape. FIG. 11 is a graph obtained by changing the other extension rates of the extended portions in the circumferential wall 4*c* of the centrifugal fan 1 in FIG. 10. Note that the one dot chain line shown in FIG. 10 shows the position of a fourth extended portion 54. The centrifugal fan 1 according to Embodiment 1 shown in FIG. 10 includes the fourth extended portion 54 forming the fourth maximum point P4 in a section of the circumferential wall 4*c* at which the angle θ is 90 degrees to 270 degrees (angle α) being a region opposite to the discharge port 72 of the scroll casing 4. The centrifugal fan 1 according to Embodiment 1 shown in FIG. 10 further includes the second extended portion 52 including the second maximum point P2 and the third extended portion 53 including the third maximum point P3 on the fourth extended portion 54 including the fourth maximum point P4. As shown in FIG. 10, the circumferential wall 4*c* includes the first extended portion 51 bulging out to the radially outer side of the standard circumferential wall SW having a logarithmic spiral shape in a section in which the angle θ is 0 degrees or more and less than 90 degrees. As shown in FIG. 11, the first extended portion 51 includes the first maximum point P1 in a section in which the angle θ is 0 degrees or more and less than 90 degrees. The first maximum point P1 is a position in the circumferential wall 4*c* at which the length of the difference LH1 between the distance L1 between the axis C1 of the rotational shaft X and the circumferential wall 4*c* and the distance L2 between the axis C1 of the rotational shaft X and the standard circumferential wall SW is the greatest in a section in which the angle θ is 0 degrees or more and less than 90 degrees. As shown in FIG. 10, the circumferential wall 4*c* includes the second extended portion 52 bulging out to the radially outer side of the standard circumferential wall SW having a logarithmic spiral shape in a section in which the angle θ is 90 degrees or more and less than 180 degrees. As shown in FIG. 11, the second extended portion 52 includes the second maximum point P2 in a section in which the angle θ is 90 degrees or more and less than 180 degrees. The second maximum point P2 is a position in the circumferential wall 4*c* at which the length of the difference LH2 between the distance L1 between the axis C1 of the rotational shaft X and the circumferential wall 4*c* and the distance L2 between the axis C1 of the rotational shaft X and the standard circumferential wall SW is the greatest in a section in which the angle θ is 90 degrees or more and less than 180 degrees. As shown in FIG. 10, the circumferential wall 4*c* includes the third extended portion 53 bulging out to the radially outer side of the standard circumferential wall SW having a logarithmic spiral shape in a section in which the angle θ is 180 degrees or more and less than the angle α formed by the second reference line. As shown in FIG. 11, the third extended portion 53 includes the third maximum point P3 in a section in which the angle θ is 180 degrees or more and less than the angle α formed by the second reference line. The third maximum point P3 is a position in the circumferential wall 4*c* at which the length of the difference LH3 between the distance L1 between the axis C1 of the rotational shaft X and the circumferential wall 4*c* and the distance L2 between the axis C1 of the rotational shaft X and the standard circumferential wall SW is the greatest in a section in which the angle θ is 180 degrees or more and less than the angle α. As shown in FIG. 10, the circumferential wall 4*c* includes the fourth extended portion 54 bulging out to the radially outer side of the standard circumferential wall SW having a logarithmic spiral shape in a section in which the angle θ is 90 degrees or more and less than the angle α formed by the second reference line. As shown in FIG. 11, the fourth extended portion 54 includes the fourth maximum point P4 in a section in which the angle θ is 90 degrees or more and less than the angle α formed by the second reference line. The fourth maximum point P4 is a position in the circumferential wall 4*c* at which the length of the difference LH4 between the distance L1 between the axis C1 of the rotational shaft X and the circumferential wall 4*c* and the distance L2 between the axis C1 of the rotational shaft X and the standard circumferential wall SW is the greatest in a section in which the angle θ is 90 degrees or more and less than the angle α. The centrifugal fan 1 further includes the second extended portion 52 including the second maximum point P2 and the third extended portion 53 including the third maximum point P3 on the fourth extended portion 54 including the fourth maximum point P4. Therefore, in the circumferential wall 4*c* forming a region from the second extended portion 52 to the third extended portion 53, the distance L1 between the axis C1 of the rotational shaft X and the circumferential wall 4*c* is greater than the distance L2 between the axis C1 of the rotational shaft X and the standard circumferential wall SW.

Figure 12:
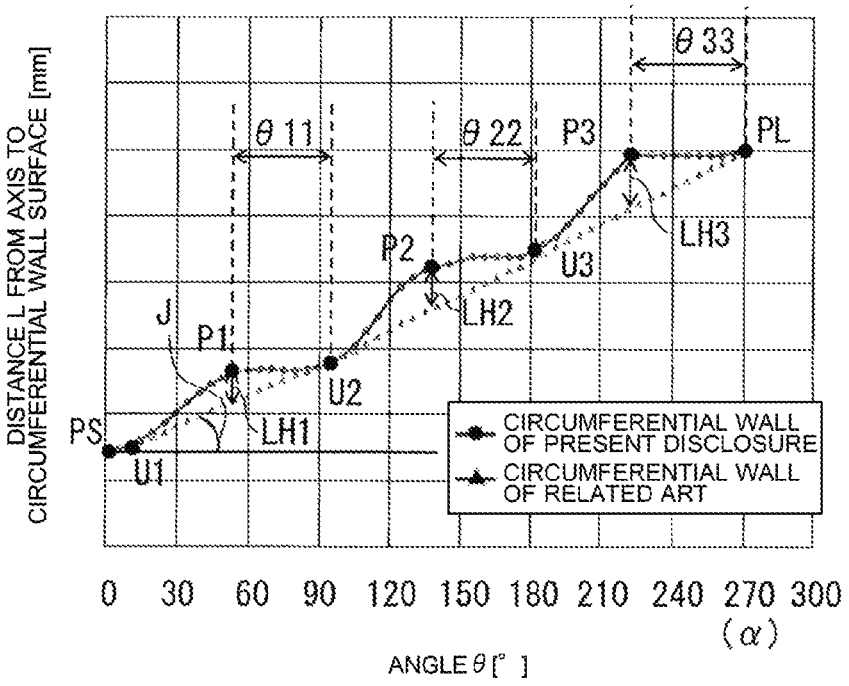
FIG. 12 shows the other extension rates in the circumferential wall of the centrifugal fan according to Embodiment 1 in FIG. 5.

FIG. 12 is a graph showing other extension rates in the circumferential wall 4*c* of the centrifugal fan 1 according to Embodiment 1 in FIG. 5. FIG. 12 shows a more-desirable shape of the circumferential wall 4*c* with reference to FIG. 5. A difference L44 (not shown) between the distance L1 at the second minimum point U2 and the distance L1 at the first maximum point P1 relative to an increase θ11 of the angle θ from the first maximum point P1 to the second minimum point U2 is an extension rate D. A difference L55 (not shown) between the distance L1 at the third minimum point U3 and the distance L1 at the second maximum point P2 relative to an increase θ22 of the angle θ from the second maximum point P2 to the third minimum point U3 is an extension rate E. A difference L66 (not shown) between the distance L1 at the angle α and the distance L1 at the third maximum point P3 relative to an increase θ33 of the angle θ from the third maximum point P3 to the angle α is an extension rate F. The distance L2 between the axis C1 of the rotational shaft X and the standard circumferential wall SW relative to the increase of the angle θ is an extension rate J. In the cases above, in the circumferential wall 4*c* of the centrifugal fan 1, the extension rate J>the extension rate D≥0, the extension rate J>the extension rate E≥0, and the extension rate J>the extension rate F≥0 are desired to be satisfied. Note that, although the circumferential wall 4*c* is desired to have a shape having the extension rates described with reference to FIG. 12, the circumferential wall 4*c* does not necessarily need to have a shape having the extension rates described with reference to FIG. 12. The circumferential wall 4*c* having a structure with the extension rates shown in FIG. 12 may be combined with the circumferential wall 4*c* having a structure with the extension rates shown in FIG. 6, the circumferential wall 4*c* having a structure with the extension rates shown in FIG. 9, and the circumferential wall 4*c* having a structure with the extension rates shown in FIG. 11.

Figure 13:
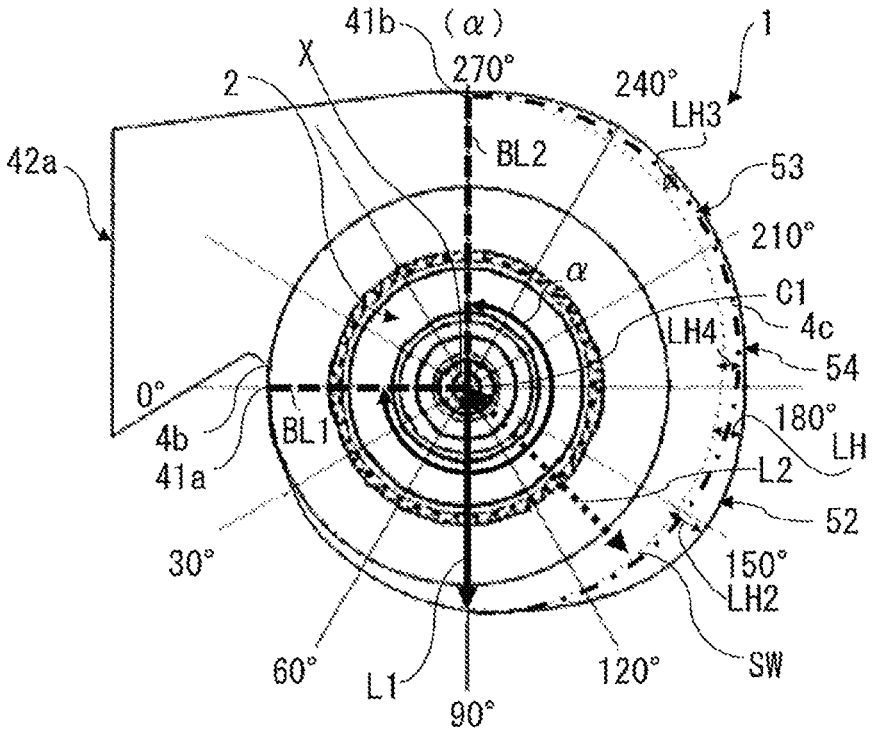
FIG. 13 is a top view illustrating a comparison between the circumferential wall of the centrifugal fan according to Embodiment 1 of the present disclosure having other extension rates and the standard circumferential wall SW of the centrifugal fan of the related art having a logarithmic spiral shape.
Figure 14:
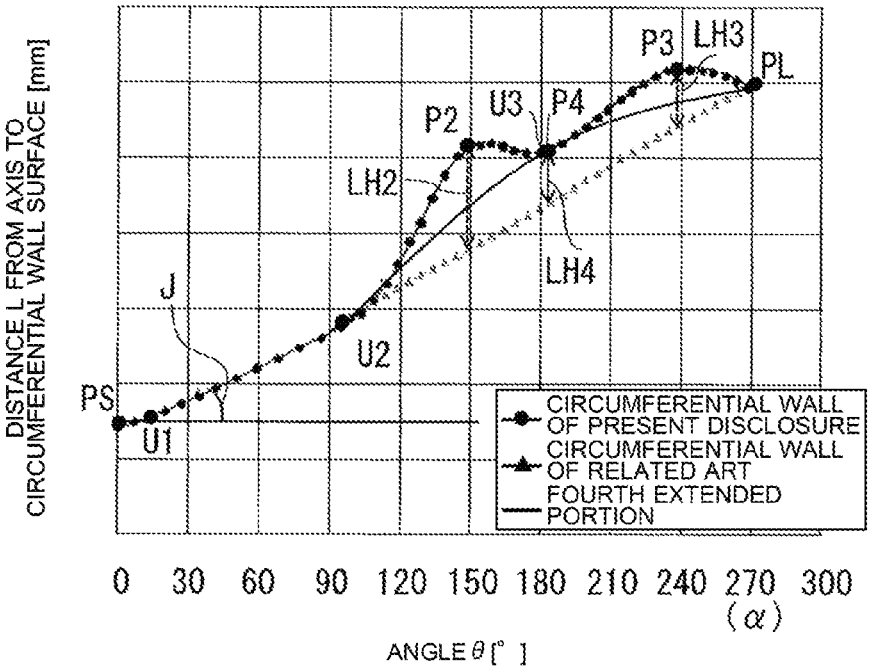
FIG. 14 is a graph obtained by changing the other extension rates of the extended portions in the circumferential wall of the centrifugal fan in FIG. 13.

FIG. 13 is a top view illustrating a comparison between the circumferential wall 4*c* of the centrifugal fan 1 according to Embodiment 1 of the present disclosure having other extension rates and the standard circumferential wall SW of the centrifugal fan of the related art having a logarithmic spiral shape. FIG. 14 is a graph obtained by changing the other extension rates of the extended portions in the circumferential wall 4*c* of the centrifugal fan 1 in FIG. 13. Note that the one dot chain line shown in FIG. 13 shows the position of the fourth extended portion 54. The centrifugal fan 1 according to Embodiment 1 shown in FIG. 13 includes the fourth extended portion 54 forming the fourth maximum point P4 in a section of the circumferential wall 4*c* at which the angle θ is 90 degrees to 270 degrees (angle α) being a region opposite to the discharge port 72 of the scroll casing 4. The centrifugal fan 1 according to Embodiment 1 shown in FIG. 13 further includes the second extended portion 52 including the second maximum point P2 and the third extended portion 53 including the third maximum point P3 on the fourth extended portion 54 including the fourth maximum point P4. As shown in FIG. 13, the circumferential wall 4*c* has a circumferential wall along the standard circumferential wall SW having a logarithmic spiral shape in a section in which the angle θ is 0 degrees or more and less than 90 degrees. In other words, in the circumferential wall 4*c*, the distance L1 between the axis C1 of the rotational shaft X and the circumferential wall 4*c* is equal to the distance L2 between the axis C1 of the rotational shaft X and the standard circumferential wall SW in a section in which the angle θ is 0 degrees or more and less than 90 degrees. As shown in FIG. 13, the circumferential wall 4*c* includes the second extended portion 52 bulging out to the radially outer side of the standard circumferential wall SW having a logarithmic spiral shape in a section in which the angle θ is 90 degrees or more and less than 180 degrees. As shown in FIG. 14, the second extended portion 52 includes the second maximum point P2 in a section in which the angle θ is 90 degrees or more and less than 180 degrees. The second maximum point P2 is a position in the circumferential wall 4*c* at which the length of the difference LH2 between the distance L1 between the axis C1 of the rotational shaft X and the circumferential wall 4*c* and the distance L2 between the axis C1 of the rotational shaft X and the standard circumferential wall SW is the greatest in a section in which the angle θ is 90 degrees or more and less than 180 degrees. As shown in FIG. 13, the circumferential wall 4*c* includes the third extended portion 53 bulging out to the radially outer side of the standard circumferential wall SW having a logarithmic spiral shape in a section in which the angle θ is 180 degrees or more and less than the angle α formed by the second reference line. As shown in FIG. 14, the third extended portion 53 includes the third maximum point P3 in a section in which the angle θ is 180 degrees or more and less than the angle α formed by the second reference line. The third maximum point P3 is a position in the circumferential wall 4*c* at which the length of the difference LH3 between the distance L1 between the axis C1 of the rotational shaft X and the circumferential wall 4*c* and the distance L2 between the axis C1 of the rotational shaft X and the standard circumferential wall SW is the greatest in a section in which the angle θ is 180 degrees or more and less than the angle α. As shown in FIG. 13, the circumferential wall 4*c* includes the fourth extended portion 54 bulging out to the radially outer side of the standard circumferential wall SW having a logarithmic spiral shape in a section in which the angle θ is 90 degrees or more and less than the angle α formed by the second reference line. As shown in FIG. 14, the fourth extended portion 54 includes the fourth maximum point P4 in a section in which the angle θ is 90 degrees or more and less than the angle α formed by the second reference line. The fourth maximum point P4 is a position in the circumferential wall 4*c* at which the length of the difference LH4 between the distance L1 between the axis C1 of the rotational shaft X and the circumferential wall 4*c* and the distance L2 between the axis C1 of the rotational shaft X and the standard circumferential wall SW is the greatest in a section in which the angle θ is 90 degrees or more and less than the angle α. The centrifugal fan 1 further includes the second extended portion 52 including the second maximum point P2 and the third extended portion 53 including the third maximum point P3 on the fourth extended portion 54 including the fourth maximum point P4. Therefore, in the circumferential wall 4*c* forming the region from the second extended portion 52 to the third extended portion 53, the distance L1 between the axis C1 of the rotational shaft X and the circumferential wall 4*c* is greater than the distance L2 between the axis C1 of the rotational shaft X and the standard circumferential wall SW.

(Tongue Portion 4*b*)

The tongue portion 4*b* guides the air flow generated by the fan 2 to the discharge port 42*a* via the scroll portion 41. The tongue portion 4*b* is a protruding portion provided in a boundary portion between the scroll portion 41 and the discharge portion 42. The tongue portion 4*b* extends in a direction parallel to the rotational shaft X in the scroll casing 4.

[Operation of Centrifugal Fan 1]

When the fan 2 rotates, the air outside the scroll casing 4 is suctioned into the scroll casing 4 through the suction ports 5. The air suctioned into the scroll casing 4 is suctioned by the fan 2 by being guided by the bell mouths 3. In the process in which the air suctioned by the fan 2 passes through the plurality of blades 2*d*, the air suctioned by the fan 2 is turned to be an air flow to which the dynamic pressure and the static pressure are applied and is blown out toward the radially outer side of the fan 2. In the air flow blown out from the fan 2, the dynamic pressure is converted to the static pressure while the air flow is guided between the inner side of the circumferential wall 4*c* and the blades 2*d* in the scroll portion 41. The air flow passes through the scroll portion 41, and then is blown out to the outside of the scroll casing 4 from the discharge port 42*a* formed at the discharge portion 42.

As described above, in the centrifugal fan 1 according to Embodiment 1, the distance L1 is equal to the distance L2 at the first end 41*a* and the second end 41*b* in the circumferential wall 4*c* in comparison with the centrifugal fan including the standard circumferential wall SW having a logarithmic spiral shape in cross-section perpendicular to the rotational shaft X of the fan 2. In the circumferential wall 4*c*, between the first end 41*a* and the second end 41*b* of the circumferential wall 4*c*, the distance L1 is greater than or equal to the distance L2. The circumferential wall 4*c* includes the plurality of extended portions between the first end 41*a* and the second end 41*b* of the circumferential wall 4*c*. The plurality of extended portions include maximum points each having a length being the difference LH between the distance L1 and the distance L2. In the centrifugal fan 1, the dynamic pressure is increased when the distance between the fan 2 and the wall surface of the circumferential wall 4*c* is the smallest near the tongue portion 4*b*. To recover the pressure from the dynamic pressure to the static pressure, the dynamic pressure is converted to the static pressure by reducing the speed by gradually extending the distance between the fan 2 and the wall surface of the circumferential wall 4*c* in the flow direction of the air flow. At this time, ideally, the amount of pressure recovery can be increased and the air-sending efficiency can be increased as the distance for which the air flow flows along the circumferential wall 4*c* increases. In other words, a configuration in which the maximum pressure recovery can be obtained is obtained when the configuration includes the circumferential wall 4*c* having extension rates greater than or equal to the extension rates of a normal logarithmic spiral shape (involute curve), and when the circumferential wall 4*c* of the scroll portion 41 is configured to have extension rates set within the range in which the separation of the air flow due to sudden extension such as an extension causing the air flow to be bent at almost a right angle does not occur, for example. The centrifugal fan 1 according to Embodiment 1 further includes a plurality of extended portions from a uniform logarithmic spiral shape (involute curve), and can extend the distance of the air passage in the scroll portion 41. As a result, the centrifugal fan 1 can convert the dynamic pressure to the static pressure by reducing the speed of the air flow flowing in the scroll casing 4 while preventing the separation of the air flow, and hence can improve the air-sending efficiency while reducing the noise. The centrifugal fan 1 can increase the distance of the air passage in which the distance between the axis C1 of the rotational shaft X and the circumferential wall 4*c* is extended by including the abovementioned configuration in the direction in which the circumferential wall 4*c* can be extended even when the extension rate of the circumferential wall 4*c* of the scroll casing to a predetermined direction cannot be sufficiently secured due to a restriction in the external dimensions depending on the place of installation. As a result, the centrifugal fan 1 can improve the air-sending efficiency while reducing the noise because the centrifugal fan 1 can convert the dynamic pressure to the static pressure by reducing the speed of the air flow flowing in the scroll casing 4 while preventing the separation of the air flow even when the extension rate of the circumferential wall 4*c* of the scroll casing to a predetermined direction cannot be sufficiently secured.

In the centrifugal fan 1, the three extended portions includes the first maximum point P1 in a section in which the angle θ is 0 degrees or more and less than 90 degrees, the second maximum point P2 in a section in which the angle θ is 90 degrees or more and less than 180 degrees, and the third maximum point P3 in a section in which the angle θ is 180 degrees or more and less than the angle α formed by the second reference line. The present disclosure further includes extended portions having three maximum points in addition to a uniform logarithmic spiral shape (involute curve), and hence can extend the distance of the air passage in the scroll portion 41. When the extension rates of the logarithmic spiral shape (involute curve) of the related art are set as the standard, a case of the extended portions including three maximum points always has the highest extension rates as compared to a case of the extended portions including two maximum points because the configuration thereof is included in the extended portions including three maximum points. Therefore, as compared to the centrifugal fan including the standard circumferential wall SW having a logarithmic spiral shape of the related art, the centrifugal fan 1 satisfying the relationship can extend the distance between the axis C1 of the rotational shaft X and the circumferential wall 4*c* and extend the distance of the air passage while preventing the separation of the air flow. For example, when a device (for example, an air-conditioning apparatus) in which the centrifugal fan 1 is installed has a restriction in external dimensions due to its low profile or the like, there may be a case where the distance between the axis C1 of the rotational shaft X and the circumferential wall 4*c* of the centrifugal fan 1 cannot be extended in the direction in which the angle θ is 270 degrees or the direction in which the angle θ is 90 degrees. The centrifugal fan 1 includes three maximum points in a section in which the angle θ is within the abovementioned range, and hence can increase the distance of the air passage in which the distance between the axis C1 of the rotational shaft X and the circumferential wall 4*c* is extended even when the device in which the centrifugal fan 1 is installed has a restriction in external dimensions due to its low profile or the like. As a result, the centrifugal fan 1 can convert the dynamic pressure to the static pressure by reducing the speed of the air flow flowing in the scroll casing 4 while preventing the separation of the air flow, and hence can improve the air-sending efficiency while reducing the noise.

In the centrifugal fan 1, the extension rates of the three extended portions of the circumferential wall 4*c* satisfy a relationship of the extension rate B>the extension rate C, and the extension rate B≥the extension rate A>the extension rate C, or a relationship of the extension rate B>the extension rate C, and the extension rate B>the extension rate C≥the extension rate A. The scroll portion 41 also has a function of raising the dynamic pressure in a region in which the angle θ is 0 degrees to 90 degrees, and hence the static pressure conversion can be increased more when the extension rates of a region in which the angle θ is 90 degrees to 180 degrees are increased as compared to increasing the extension rates of the region above. Therefore, as compared to the centrifugal fan including the standard circumferential wall SW having a logarithmic spiral shape of the related art, the centrifugal fan 1 satisfying the relationship can extend the distance between the axis C1 of the rotational shaft X and the circumferential wall 4*c* and extend the distance of the air passage while preventing the separation of the air flow in a region with excellent static pressure conversion efficiency. As a result, the centrifugal fan 1 can convert the dynamic pressure to the static pressure by reducing the speed of the air flow flowing in the scroll casing 4 while preventing the separation of the air flow, and hence can improve the air-sending efficiency while reducing the noise. When a device (for example, an air-conditioning apparatus) in which the centrifugal fan 1 is installed has a restriction in external dimensions due to its low profile or the like, there may be a case where the distance between the axis C1 of the rotational shaft X and the circumferential wall 4*c* of the centrifugal fan 1 cannot be extended in the direction in which the angle θ is 270 degrees or the direction in which the angle θ is 90 degrees. The centrifugal fan 1 includes the abovementioned extension rates, and hence can increase the distance of the air passage in which the distance between the axis C1 of the rotational shaft X and the circumferential wall 4*c* is extended even when the device in which the centrifugal fan 1 is installed has a restriction in external dimensions due to its low profile or the like. As a result, the centrifugal fan 1 can convert the dynamic pressure to the static pressure by reducing the speed of the air flow flowing in the scroll casing 4 while preventing the separation of the air flow, and hence can improve the air-sending efficiency while reducing the noise.

In the centrifugal fan 1, the extension rates of the three extended portions of the circumferential wall 4*c* satisfy a relationship of the extension rate C>the extension rate B≥the extension rate A. The scroll portion 41 also has a function of raising the dynamic pressure in a region in which the angle θ is 0 degrees to 90 degrees, and hence the static pressure conversion can be increased when the extension rates of a region in which the angle θ is 90 degrees to 180 degrees are increased as compared to raising the extension rates of the region above. However, a part of the function of the scroll portion 41 for raising the dynamic pressure also remains in the region in which the angle θ is 90 degrees to 180 degrees. Therefore, the air-sending efficiency further increases when the extension rate is increased in a region in which the angle θ is 180 degrees to 270 degrees as compared to when the extension rate is increased in the region in which the angle θ is 90 degrees to 180 degrees. In the region (the angle θ is 180 degrees to 270 degrees) in which the distance between the fan 2 and the circumferential wall 4*c* is the farthest, the function of the scroll portion 41 for raising the dynamic pressure is almost lost. Therefore, the air-sending efficiency can be maximized by maximizing the extension rate of the scroll portion 41 in that region. As a result, the centrifugal fan 1 can improve the air-sending efficiency while reducing the noise.

In the centrifugal fan 1, the plurality of extended portions include the first extended portion 51 including the first maximum point P1 in a section in which the angle θ is 0 degrees or more and less than 90 degrees, the second extended portion 52 including the second maximum point P2 in a section in which the angle θ is 90 degrees or more and less than 180 degrees, and the third extended portion 53 including the third maximum point P3 in a section in which the angle θ is 180 degrees or more and less than the angle α formed by the second reference line. In the circumferential wall 4*c* forming the region from the second extended portion 52 to the third extended portion 53, the distance L1 between the axis C1 of the rotational shaft X and the circumferential wall 4*c* is greater than the distance L2 between the axis C1 of the rotational shaft X and the standard circumferential wall SW. The centrifugal fan 1 has a configuration in which the scroll bulges out to the opposite side of the discharge port 72, and hence can extend the distance of the wall surface of the scroll along the flow of the air flow by the effect of the three extended portions and the bulged-out scroll. As a result, the centrifugal fan 1 can convert the dynamic pressure to the static pressure by reducing the speed of the air flow flowing in the scroll casing 4 while preventing the separation of the air flow, and hence can improve the air-sending efficiency while reducing the noise.

In the centrifugal fan 1, the plurality of extended portions include the second extended portion 52 including the second maximum point P2 in a section in which the angle θ is 90 degrees or more and less than 180 degrees, and the third extended portion 53 including the third maximum point P3 in a section in which the angle θ is 180 degrees or more and less than the angle α formed by the second reference line. In the circumferential wall 4*c* forming the region from the second extended portion 52 to the third extended portion 53, the distance L1 between the axis C1 of the rotational shaft X and the circumferential wall 4*c* is greater than the distance L2 between the axis C1 of the rotational shaft X and the standard circumferential wall SW. The centrifugal fan 1 has a configuration in which the scroll bulges out to the side opposite to the discharge port 72, and hence can extend the distance of the wall surface of the scroll along the flow of the air flow by the effect of the two extended portions and the bulged-out scroll. As a result, the centrifugal fan 1 can convert the dynamic pressure to the static pressure by reducing the speed of the air flow flowing in the scroll casing 4 while preventing the separation of the air flow, and hence can improve the air-sending efficiency while reducing the noise.

In the centrifugal fan 1, the circumferential wall 4*c* of the centrifugal fan 1 is desired to satisfy the extension rate J>the extension rate D≥0, the extension rate J>the extension rate E≥0, and the extension rate J>the extension rate F≥0. Because the circumferential wall 4*c* of the centrifugal fan 1 has the abovementioned extension rates, the air passage between the rotational shaft X and the circumferential wall 4*c* does not narrow, a pressure loss of the air flow generated by the fan 2 is not generated. As a result, the centrifugal fan 1 can reduce the speed and convert the dynamic pressure to the static pressure, and can improve the air-sending efficiency while reducing the noise.

Embodiment 2

Figure 15:
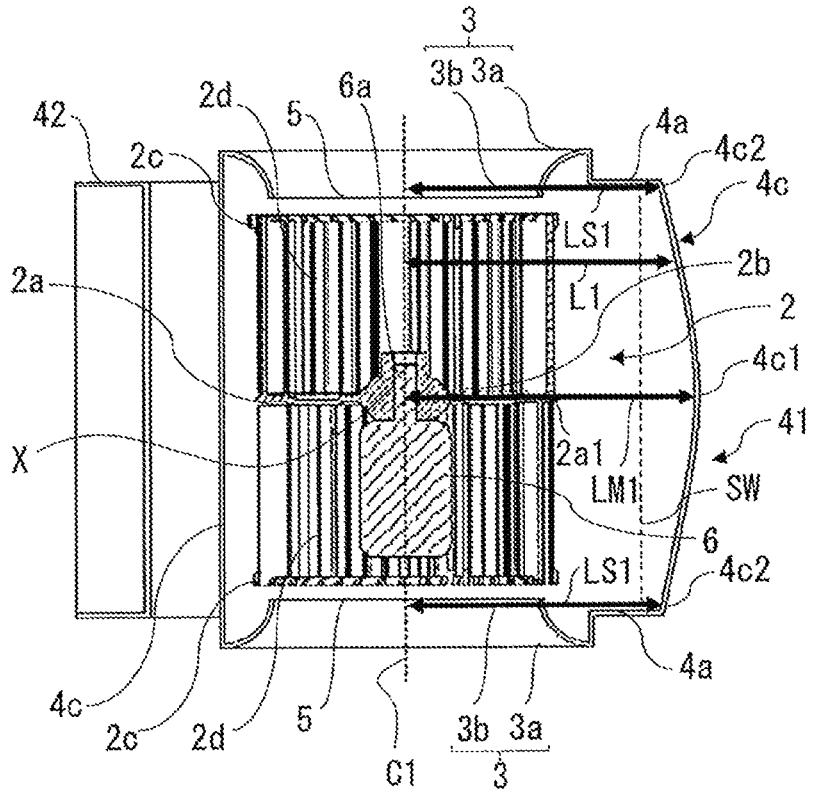
FIG. 15 is a cross-sectional view of a centrifugal fan according to Embodiment 2 of the present disclosure taken along the axis direction.

FIG. 15 is a cross-sectional view of a centrifugal fan 1 according to Embodiment 2 of the present disclosure 1 taken along the axis direction. The dotted line shown in FIG. 15 shows the position of the standard circumferential wall SW of the centrifugal fan having a logarithmic spiral shape being a related-art example. Note that sections having the same configurations as the centrifugal fan 1 in FIG. 1 to FIG. 14 are denoted by the same reference characters, and descriptions thereof are omitted. The centrifugal fan 1 of Embodiment 2 is the centrifugal fan 1 including the double-suction scroll casing 4 having the side walls 4*a* in which the suction ports 5 are formed on both sides of the main plate 2*a* in the axis direction of the rotational shaft X. As shown in FIG. 15, in the centrifugal fan 1 of Embodiment 2, the circumferential wall 4*c* extends more to the radial direction of the rotational shaft X as the circumferential wall 4*c* is farther away from the suction ports 5 in the axis direction of the rotational shaft X. In other words, in the centrifugal fan 1 of Embodiment 2, in the axis direction of the rotational shaft X, the distance between the axis C1 of the rotational shaft X and the inner wall surface of the circumferential wall 4*c* increases as the circumferential wall 4*c* is farther away from the suction ports 5. In the circumferential wall 4*c* of the centrifugal fan 1, the distance L1 between the axis C1 of the rotational shaft X and the inner wall surface of the circumferential wall 4*c* is the greatest at a position 4*c*1 facing the circumferential portion 2*a*1 of the main plate 2*a* in the direction parallel to the axis direction of the rotational shaft X. A distance LM1 shown in FIG. 15 shows a portion at which the distance L1 between the axis C1 of the rotational shaft X and the inner wall surface of the circumferential wall 4*c* is the greatest in the direction parallel to the axis direction of the rotational shaft X at the position 4*c*1 in the circumferential wall 4*c* facing the circumferential portion 2*a*1 of the main plate 2*a*. In the circumferential wall 4*c* of the centrifugal fan 1, the distance L1 between the axis C1 of the rotational shaft X and the inner wall surface of the circumferential wall 4*c* is the smallest at positions 4*c*2 being boundaries with the side walls 4*a* in the direction parallel to the axis direction of the rotational shaft X. Each of distances LS1 shown in FIG. 15 shows a portion at which the distance L1 between the axis C1 of the rotational shaft X and the inner wall surface of the circumferential wall 4*c* is the smallest in the direction parallel to the axis direction of the rotational shaft X at the position 4*c*2 being the boundary between the circumferential wall 4*c* and the side wall 4*a*. The circumferential wall 4*c* bulges out at the position 4*c*1 facing the circumferential portion 2*a*1 of the main plate 2*a* in the direction parallel to the rotational shaft X, and the distance L1 is the greatest at the position 4*c*1 facing the circumferential portion 2*a*1 of the main plate 2*a* in the direction parallel to the rotational shaft X. In other words, in the centrifugal fan 1 of Embodiment 2, the circumferential wall 4*c* is formed in an arc shape, so that the distance L1 between the axis C1 of the rotational shaft X and the inner wall surface of the circumferential wall 4*c* is the greatest at a position facing the circumferential portion 2*a*1 of the main plate 2*a* in a cross-sectional view parallel to the rotational shaft X. Note that, in the circumferential wall 4*c* in cross-section, the circumferential wall 4*c* only needs to be formed in a convex shape, so that the distance L1 between the axis C1 of the rotational shaft X and the inner wall surface of the circumferential wall 4*c* is the greatest at the position 4*c*1 facing the circumferential portion 2*a*1 of the main plate 2*a*, and may include a linear portion in a part or the entirety thereof in cross-section.

Figure 16:
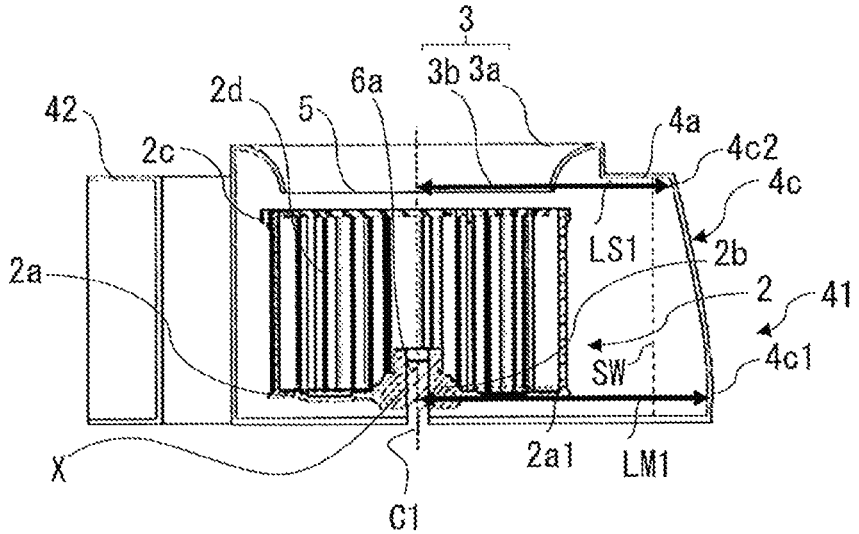
FIG. 16 is a cross-sectional view of a modified example of the centrifugal fan according to Embodiment 2 of the present disclosure taken along the axis direction.

FIG. 16 is a cross-sectional view of a modified example of the centrifugal fan 1 according to Embodiment 2 of the present disclosure taken along the axis direction. The dotted line shown in FIG. 16 shows the position of the standard circumferential wall SW of the centrifugal fan of the related-art example having a logarithmic spiral shape. Note that sections having the same configurations as the centrifugal fan 1 in FIG. 1 to FIG. 14 are denoted by the same reference characters, and descriptions thereof are omitted. The modified example of the centrifugal fan 1 of Embodiment 2 is the centrifugal fan 1 including the single-suction scroll casing 4 having the side wall 4*a* in which the suction port 5 is formed on one side of the main plate 2*a* in the axis direction of the rotational shaft X. As shown in FIG. 16, in the modified example of the centrifugal fan 1 of Embodiment 2, the circumferential wall 4*c* extends more to the radial direction of the rotational shaft X as the circumferential wall 4*c* is farther away from the suction port 5 in the axis direction of the rotational shaft X. In other words, in the centrifugal fan 1 of Embodiment 2, the distance between the axis C1 of the rotational shaft X and the inner wall surface of the circumferential wall 4*c* increases as the circumferential wall 4*c* is farther away from the suction ports 5 in the axis direction of the rotational shaft X. In the circumferential wall 4*c* of the centrifugal fan 1, the distance L1 between the axis C1 of the rotational shaft X and the inner wall surface of the circumferential wall 4*c* is the greatest at the position 4*c*1 facing the circumferential portion 2*a*1 of the main plate 2*a* in the direction parallel to the axis direction of the rotational shaft X. The distance LM1 shown in FIG. 16 shows a portion at which the distance L1 between the axis C1 of the rotational shaft X and the inner wall surface of the circumferential wall 4*c* is the greatest in the direction parallel to the axis direction of the rotational shaft X at the position 4*c*1 in the circumferential wall 4*c* facing the circumferential portion 2*a*1 of the main plate 2*a*. In the circumferential wall 4*c* of the centrifugal fan 1, the distance L1 between the axis C1 of the rotational shaft X and the inner wall surface of the circumferential wall 4*c* is the smallest at the position 4*c*2 being a boundary with the side wall 4*a* in the direction parallel to the axis direction of the rotational shaft X. The distance LS1 shown in FIG. 16 shows a portion at which the distance L1 between the axis C1 of the rotational shaft X and the inner wall surface of the circumferential wall 4*c* is the smallest in the direction parallel to the axis direction of the rotational shaft X at the position 4*c*2 being the boundary between the circumferential wall 4*c* and the side wall 4*a*. The circumferential wall 4*c* bulges out at the position 4*c*1 facing the circumferential portion 2*a*1 of the main plate 2*a* in the direction parallel to the rotational shaft X, and the distance L1 is the greatest at the position 4*c*1 facing the circumferential portion 2*a*1 of the main plate 2*a* in the direction parallel to the rotational shaft X. In other words, in the centrifugal fan 1 of Embodiment 2, the circumferential wall 4*c* is formed in a curved shape, so that the distance L1 between the axis C1 of the rotational shaft X and the inner wall surface of the circumferential wall 4*c* is the greatest at a position facing the circumferential portion 2*a*1 of the main plate 2*a* in a cross-sectional view parallel to the rotational shaft X. Note that the circumferential wall 4*c* in cross-section only needs to be formed in a convex shape in which the distance L1 between the axis C1 of the rotational shaft X and the inner wall surface of the circumferential wall 4*c* is the greatest at the position 4*c*1 facing the circumferential portion 2*a*1 of the main plate 2*a*, and may include a linear portion in a part or the entirety thereof in cross-section.

Figure 17:
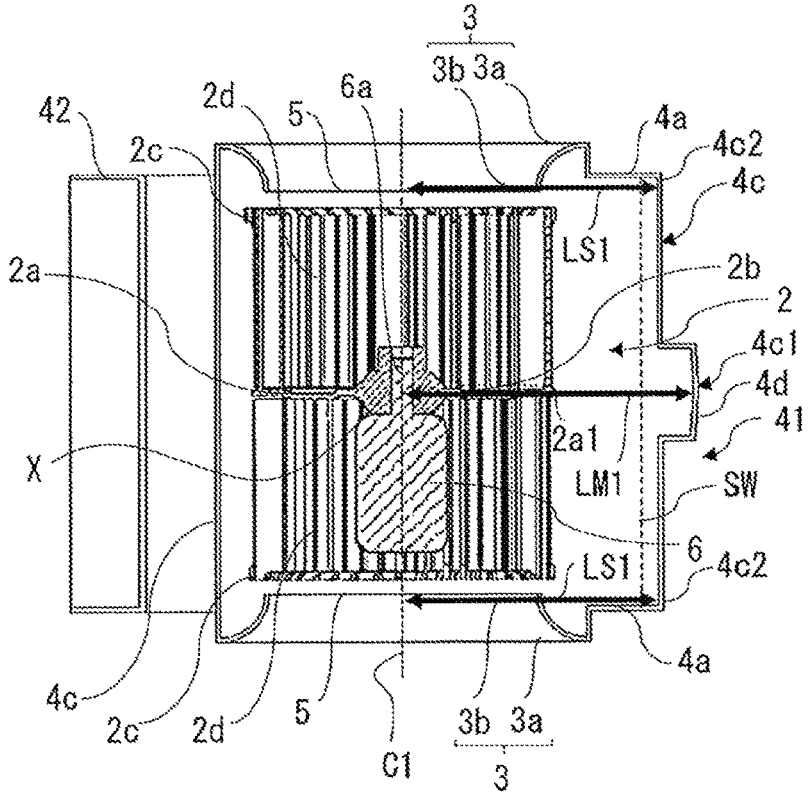
FIG. 17 is a cross-sectional view of another modified example of the centrifugal fan according to Embodiment 2 of the present disclosure taken along the axis direction.

FIG. 17 is a cross-sectional view of another modified example of the centrifugal fan 1 according to Embodiment 2 of the present disclosure taken along the axis direction. The dotted line shown in FIG. 17 shows the position of the standard circumferential wall SW of the centrifugal fan of the related-art example having a logarithmic spiral shape. Note that sections having the same configurations as the centrifugal fan 1 in FIG. 1 to FIG. 14 are denoted by the same reference characters, and descriptions thereof are omitted. The other modified example of the centrifugal fan 1 of Embodiment 2 is the centrifugal fan 1 including the double-suction scroll casing 4 having the side walls 4*a* in which the suction ports 5 are formed on both sides of the main plate 2*a* in the axis direction of the rotational shaft X. As shown in FIG. 17, the circumferential wall 4*c* of the centrifugal fan 1 of Embodiment 2 has a protruding portion 4*d* at which a part of the circumferential wall 4*c* protrudes in the radial direction of the rotational shaft X at the position 4*c*1 facing the circumferential portion 2*a*1 of the main plate 2*a* in the axis direction of the rotational shaft X. The protruding portion 4*d* is a portion in a part of the circumferential wall 4*c* at which the distance between the axis C1 of the rotational shaft X and the inner wall surface of the circumferential wall 4*c* increases in the axis direction of the rotational shaft X. The protruding portion 4*d* is formed on a portion of the circumferential wall 4*c* between the first end 41*a* and the second end 41*b* in a longitudinal direction thereof. Note that, on a portion of the circumferential wall 4*c* between the first end 41*a* and the second end 41*b*, the protruding portion 4*d* may be formed in the entire range from the first end 41*a* to the second end 41*b* or in only a part of the range. The circumferential wall 4*c* has the protruding portion 4*d* protruding to the radial direction of the rotational shaft X in the circumferential direction of the rotational shaft X. In the circumferential wall 4*c* of the centrifugal fan 1, the distance L1 between the axis C1 of the rotational shaft X and the inner wall surface of the circumferential wall 4*c* is the greatest at the position 4*c*1 facing the circumferential portion 2*a*1 of the main plate 2*a* in the direction parallel to the axis direction of the rotational shaft X. In other words, in the circumferential wall 4*c* of the centrifugal fan 1, the distance L1 between the axis C1 of the rotational shaft X and the inner wall surface of the circumferential wall 4*c* is the greatest at the protruding portion 4*d* in the direction parallel to the axis direction of the rotational shaft X. The distance LM1 shown in FIG. 17 shows a portion at which the distance L1 between the axis C1 of the rotational shaft X and the inner wall surface of the circumferential wall 4*c* is the greatest in the direction parallel to the axis direction of the rotational shaft X at the position 4*c*1 in the circumferential wall 4*c* facing the circumferential portion 2*a*1 of the main plate 2*a*. In the circumferential wall 4*c* of the centrifugal fan 1, the distance L1 between the axis C1 of the rotational shaft X and the inner wall surface of the circumferential wall 4*c* is the smallest at the positions 4*c*2 being boundaries with the side walls 4*a* in the direction parallel to the axis direction of the rotational shaft X. Each of the distances LS1 shown in FIG. 17 shows a portion at which the distance L1 between the axis C1 of the rotational shaft X and the inner wall surface of the circumferential wall 4*c* is the smallest in the direction parallel to the axis direction of the rotational shaft X at the position 4*c*2 being the boundary between the circumferential wall 4*c* and the side wall 4*a*. As shown in FIG. 17, in the circumferential wall 4*c*, the distance LS1 between the axis C1 of the rotational shaft X and the inner wall surface of the circumferential wall 4*c* is fixed in the axis direction of the rotational shaft X. Note that the protruding portion 4*d* is formed in a rectangular shape made of linear portions in cross-section, but may be formed in an arc shape made of curved portions, for example, or may be other shapes having a linear portion and a curved portion. The circumferential wall 4*c* is not limited to have a configuration in which the distance LS1 between the axis C1 of the rotational shaft X and the inner wall surface of the circumferential wall 4*c* is fixed in the axis direction of the rotational shaft X. In the circumferential wall 4*c*, the distance L1 between the axis C1 of the rotational shaft X and the inner wall surface of the circumferential wall 4*c* may be extended from the side walls 4*a* to the protruding portion 4*d*, for example.

The centrifugal fan including the standard circumferential wall SW having a logarithmic spiral shape being the related-art example, has the following features regarding the air flow flowing in the air passage in the portion at a position 4*c*1 or the position 4*c*2 in the circumferential wall 4*c* in the direction parallel to the axis direction of the rotational shaft X. In the centrifugal fan of the related art, the speed of the air flow is fast and the dynamic pressure is high in the air passage between the circumferential wall 4*c* at the position 4*c*1 and the rotational shaft X. In the centrifugal fan of the related art, the speed of the air flow is slow and the dynamic pressure is low in the air passage between the circumferential wall 4*c* at the position 4*c*2 and the rotational shaft X. Therefore, in the centrifugal fan of the related art, a case where the air flow does not flow along the inner peripheral surface of the circumferential wall 4*c* may tend to occur as the air flow flows from the center portion of the circumferential wall 4*c* to the suction end in the direction parallel to the axis direction of the rotational shaft X. Meanwhile, in the centrifugal fan 1 of Embodiment 2 and the centrifugal fans 1 of the modified examples, the distance L1 between the axis C1 of the rotational shaft X and the inner wall surface of the circumferential wall 4*c* is the greatest at the position 4*c*1 in the circumferential wall 4*c* facing the circumferential portion 2*a*1 of the main plate 2*a* when seen from the direction parallel to the rotational shaft X. Therefore, the air flow tends to be collected in the air passage at a portion of the circumferential wall 4*c* at the position 4*c*1 at which the speed of the air flow is fast and the dynamic pressure is high along the circumferential wall 4*c* in cross-section, and a portion at which the speed of the air flow is slow and the dynamic pressure is low can be reduced in the air passage. As a result, in the centrifugal fans 1 of Embodiment 2 and the modified examples, the air flow can be efficiently caused to flow along the inner peripheral surface of the circumferential wall 4*c*.

As described above, in the centrifugal fan 1 according to Embodiment 2 and the modified examples, the distance L1 between the axis C1 of the rotational shaft X and the inner wall surface of the circumferential wall 4*c* is the greatest at the position 4*c*1 in the circumferential wall 4*c* facing the circumferential portion 2*a*1 of the main plate 2*a* when seen from the direction parallel to the rotational shaft X. Therefore, in the circumferential wall 4*c* in cross-section parallel to the rotational shaft X, the air flow tends to be collected in the air passage in the portion of the circumferential wall 4*c* at the position 4*c*1 at which the speed of the air flow is fast and the dynamic pressure is high. Meanwhile, in the circumferential wall 4*c* in cross-section parallel to the rotational shaft X, the air volume of the air flow flowing through the portion at the position 4*c*2 in the circumferential wall 4*c* at which the speed of the air flow is slow and the dynamic pressure is low in the air passage is reduced. As a result, in the centrifugal fans 1 of Embodiment 2 and the modified examples, the air flow can be efficiently caused to flow along the inner peripheral surface of the circumferential wall 4*c*. As compared to the centrifugal fan including the standard circumferential wall SW having a logarithmic spiral shape of the related art, the centrifugal fan 1 can increase the distance between the axis C1 of the rotational shaft X and the circumferential wall 4*c*, and can increase the distance of the air passage while preventing the separation of the air flow. As a result, the centrifugal fan 1 can reduce the speed and convert the dynamic pressure to the static pressure, and can improve the air-sending efficiency while reducing the noise.

Embodiment 3

[Air-Sending Device 30]

Figure 18:
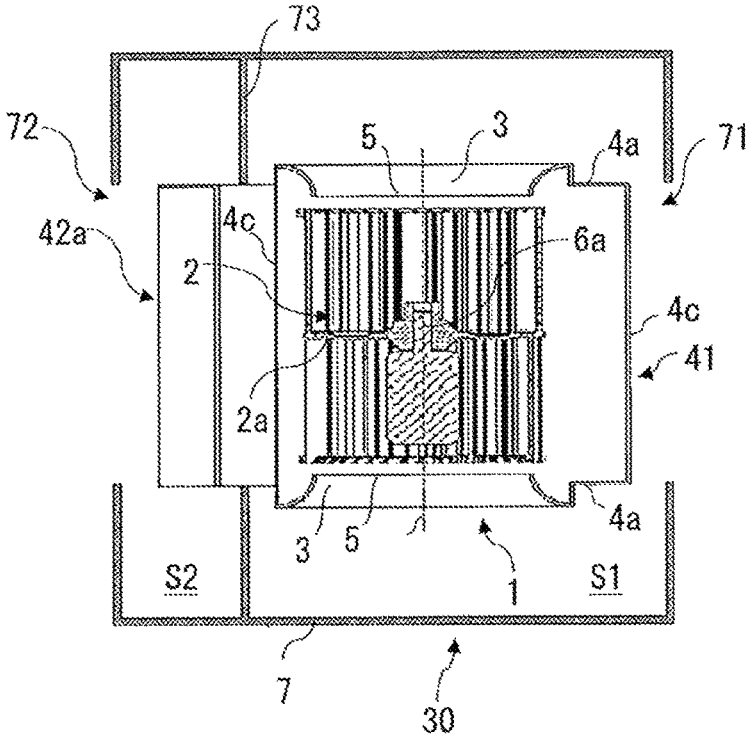
FIG. 18 illustrates a configuration of an air-sending device according to Embodiment 3 of the present disclosure.

FIG. 18 illustrates a configuration of the air-sending device 30 according to Embodiment 3 of the present disclosure. Sections having the same configurations as the centrifugal fan 1 in FIG. 1 to FIG. 14 are denoted by the same reference characters, and descriptions thereof are omitted. The air-sending device 30 according to Embodiment 3 is a ventilating fan or a desk fan, for example, and includes the centrifugal fan 1 according to Embodiment 1 or 2, and a case 7 accommodating the centrifugal fan 1. In the case 7, two opening ports, specifically, a suction port 71 and a discharge port 72 are formed. As shown in FIG. 18, the suction port 71 and the discharge port 72 are formed in opposite positions in the air-sending device 30. Note that the suction port 71 and the discharge port 72 do not necessarily need to be formed in opposite positions in the air-sending device 30. For example, either one of the suction port 71 and the discharge port 72 may be formed on the top or the bottom of the centrifugal fan 1. In the case 7, a space S1 including the portion in which the suction port 71 is formed and a space S2 including the portion in which the discharge port 72 is formed are partitioned by a partition plate 73. The centrifugal fan 1 is installed in a state in which the suction ports 5 are positioned in the space S1 in which the suction port 71 is formed and the discharge port 42*a* is positioned in the space S2 in which the discharge port 72 is formed.

When the fan 2 rotates, air is suctioned into the case 7 through the suction port 71. The air suctioned into the case 7 is guided by the bell mouths 3, and is suctioned by the fan 2. The air suctioned by the fan 2 is blown out to the radially outer side of the fan 2. The air blown out from the fan 2 is blown out from the discharge port 42*a* of the scroll casing 4 after passing through the inside of the scroll casing 4, and is blown out from the discharge port 72.

The air-sending device 30 according to Embodiment 3 includes the centrifugal fan 1 according to Embodiment 1 or 2, and hence can efficiently recover the pressure, and can improve the air-sending efficiency and reduce the noise.

Embodiment 4

[Air-Conditioning Apparatus 40]

Figure 19:
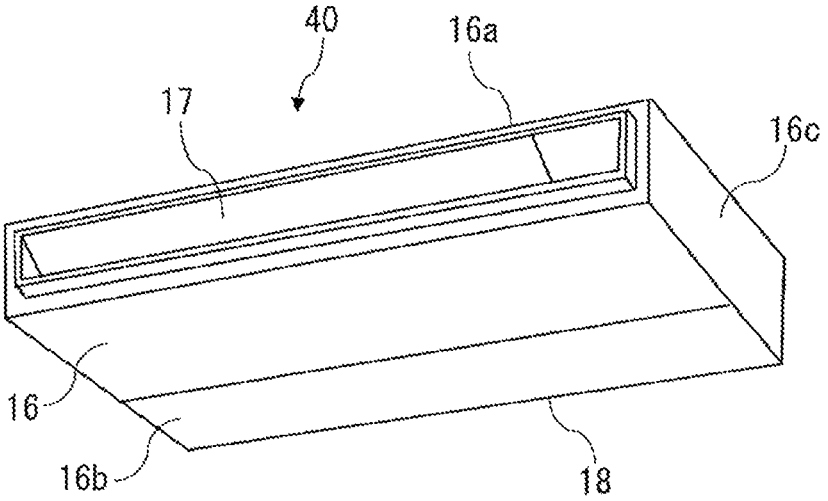
FIG. 19 is a perspective view of an air-conditioning apparatus according to Embodiment 4 of the present disclosure.
Figure 20:
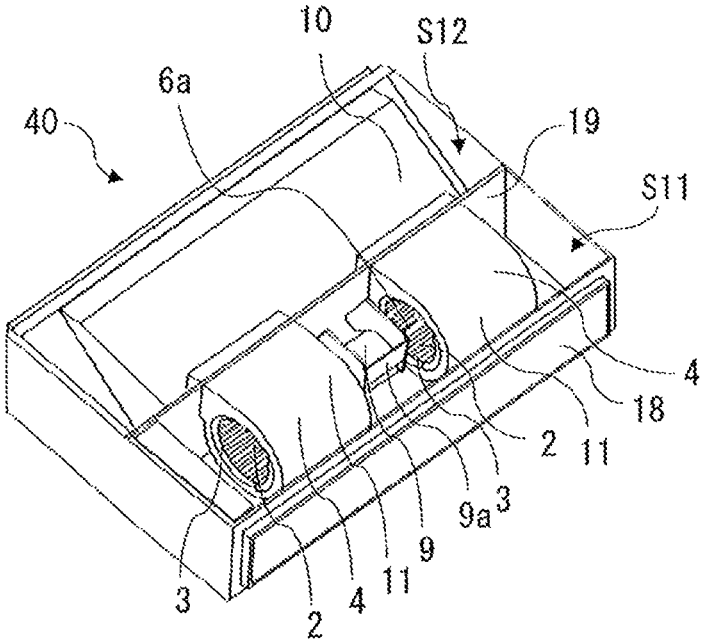
FIG. 20 illustrates an inner configuration of the air-conditioning apparatus according to Embodiment 4 of the present disclosure.
Figure 21:
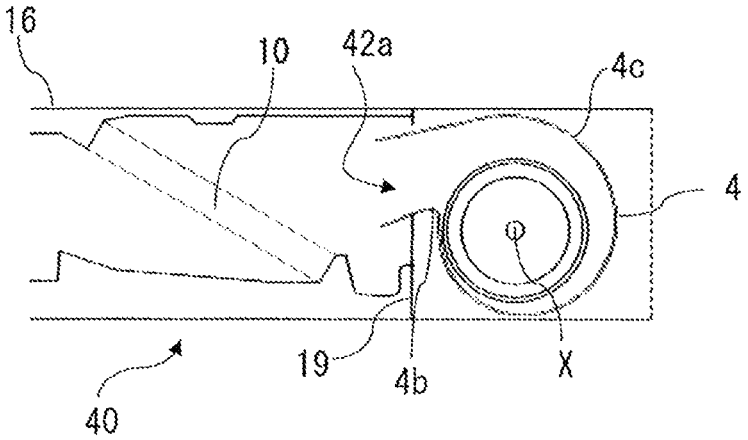
FIG. 21 is a cross-sectional view of the air-conditioning apparatus according to Embodiment 4 of the present disclosure.

FIG. 19 is a perspective view of the air-conditioning apparatus 40 according to Embodiment 4 of the present disclosure. FIG. 20 illustrates an inner configuration of the air-conditioning apparatus 40 according to Embodiment 4 of the present disclosure. FIG. 21 is a cross-sectional view of the air-conditioning apparatus 40 according to Embodiment 4 of the present disclosure. Note that, in a centrifugal fan 11 used in the air-conditioning apparatus 40 according to Embodiment 4, sections having the same configurations as the centrifugal fan 1 in FIG. 1 to FIG. 14 are denoted by the same reference characters, and descriptions thereof are omitted. In FIG. 20, an upper surface portion 16*a* is omitted to illustrate the inner configuration of the air-conditioning apparatus 40. The air-conditioning apparatus 40 according to Embodiment 4 includes the centrifugal fan 1 of Embodiment 1 or 2, and a heat exchanger 10 disposed in a position facing the discharge port 42*a* of the centrifugal fan 1. The air-conditioning apparatus 40 according to Embodiment 4 includes a case 16 installed above a ceiling of an air-conditioned room. As shown in FIG. 19, the case 16 is formed in a cuboid shape including the upper surface portion 16*a*, a lower surface portion 16*b*, and side surface portions 16*c*. Note that the shape of the case 16 is not limited to a cuboid shape, and may be other shapes such as a cylindrical shape, a prismatic shape, a conical shape, a shape having a plurality of corners, and a shape having a plurality of curved portions.

(Case 16)

The case 16 includes the side surface portion 16*c* at which a case discharge port 17 is formed as one of the side surface portions 16*c*. The shape of the case discharge port 17 is formed in a rectangular shape as shown in FIG. 19. Note that the shape of the case discharge port 17 is not limited to a rectangular shape, and may be a circular shape or an oval shape, for example, or may be other shapes. The case 16 includes the side surface portion 16*c* at which the case suction port 18 is formed on a surface opposite to the surface at which the case discharge port 17 is formed out of the side surface portions 16*c*. The shape of the case suction port 18 is formed in a rectangular shape as shown in FIG. 20. Note that the shape of the case suction port 18 is not limited to a rectangular shape, and may be a circular shape or an oval shape, for example, or may be other shapes. A filter configured to remove dust in the air, may be disposed on the case suction port 18.

In the case 16, two centrifugal fans 11, a fan motor 9, and the heat exchanger 10 are accommodated. Each of the centrifugal fans 11 includes the fan 2, and the scroll casing 4 in which the bell mouth 3 is formed. The shape of the bell mouth 3 of the centrifugal fan 11 is a shape similar to the shape of the bell mouth 3 of the centrifugal fan 1 of Embodiment 1. Each of the centrifugal fans 11 includes the fan 2 and the scroll casing 4 similar to the fan 2 and the scroll casing 4 of the centrifugal fan 1 according to Embodiment 1, but is different in that the fan motor 6 is not disposed in the scroll casing 4. The fan motor 9 is supported by a motor support 9*a* fixed to the upper surface portion 16*a* of the case 16. The fan motor 9 includes the output shaft 6*a*. The output shaft 6*a* is disposed to extend in a direction parallel to the surface at which the case suction port 18 is formed and the surface at which the case discharge port 17 is formed out of the side surface portions 16*c*. As shown in FIG. 20, in the air-conditioning apparatus 40, two fans 2 are mounted on the output shaft 6*a*. The fans 2 form the flow of the air suctioned into the case 16 from the case suction port 18 and blown out to the air-conditioned space from the case discharge port 17. Note that the number of the fans 2 disposed in the case 16 is not limited to two and may be one or three or more.

As shown in FIG. 20, the centrifugal fans 11 are installed in the partition plate 19, and the inner space of the case 16 is partitioned into a space S11 on the suction side of the scroll casing 4 and a space S12 on the blow out side of the scroll casing 4 by the partition plate 19.

As shown in FIG. 21, the heat exchanger 10 is disposed in a position facing the discharge ports 42*a* of the centrifugal fan 11, and is disposed on the air passage of the air discharged from the centrifugal fan 11 in the case 16. The heat exchanger 10 adjusts the temperature of the air suctioned into the case 16 from the case suction port 18 and blown out to the air-conditioned space from the case discharge port 17. Note that a well-known structure can be applied to the heat exchanger 10.

When the fans 2 rotate, the air in the air-conditioned space is suctioned into the case 16 through the case suction port 18. The air suctioned into the case 16 is the guided by bell mouths 3 and is suctioned by the fans 2. The air suctioned by the fans 2 is blown out toward the radially outer side of the fans 2. The air blown out from the fans 2 passes through the inside of the scroll casings 4. Then, the air is blown out from the discharge ports 42*a* of the scroll casings 4 and is supplied to the heat exchanger 10. When the air supplied to the heat exchanger 10 passes through the heat exchanger 10, the heat thereof is exchanged and the humidity thereof is adjusted. The air passing through the heat exchanger 10 is blown out to the air-conditioned space from the case discharge port 17.

The air-conditioning apparatus 40 according to Embodiment 4 includes the centrifugal fan 1 according to Embodiment 1 or 2, and hence can efficiently recover the pressure, and can improve the air-sending efficiency and reduce the noise.

Embodiment 5

[Refrigeration Cycle Apparatus 50]

Figure 22:
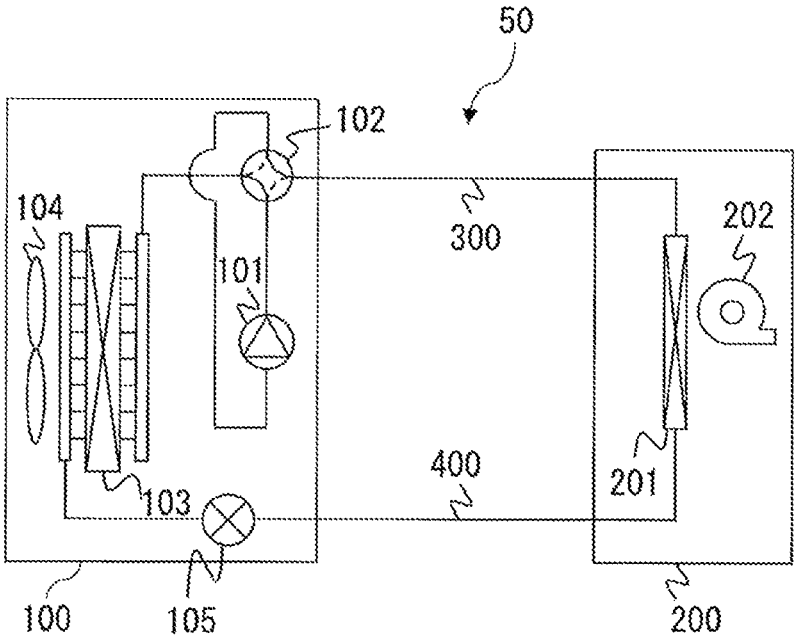
FIG. 22 illustrates a configuration of a refrigeration cycle apparatus according to Embodiment 5 of the present disclosure.

FIG. 22 illustrates the configuration of the refrigeration cycle apparatus 50 according to Embodiment 5 of the present disclosure. Note that, in the centrifugal fan 1 used in the refrigeration cycle apparatus 50 according to Embodiment 5, sections having the same configurations as those of the centrifugal fan 1 or the centrifugal fan 11 in FIG. 1 to FIG. 14 are denoted by the same reference characters, and descriptions thereof are omitted. The refrigeration cycle apparatus 50 according to Embodiment 5 conditions air by heating or cooling the inside of a room by moving the heat between the outside air and the indoor air via refrigerant. The refrigeration cycle apparatus 50 according to Embodiment 5 includes an outdoor unit 100 and an indoor unit 200. In the refrigeration cycle apparatus 50, a refrigerant circuit in which the refrigerant circulates is formed by connecting the outdoor unit 100 and the indoor unit 200 to each other by pipes, specifically, a refrigerant pipe 300 and a refrigerant pipe 400. The refrigerant pipe 300 is a gas pipe through which refrigerant in a gas phase flows, and the refrigerant pipe 400 is a liquid pipe through which refrigerant in a liquid phase flows. Note that two-phase gas-liquid refrigerant may flow through the refrigerant pipe 400. In the refrigerant circuit of the refrigeration cycle apparatus 50, a compressor 101, a flow switching device 102, an outdoor heat exchanger 103, an expansion valve 105, and an indoor heat exchanger 201 are sequentially connected to each other via the refrigerant pipes.

(Outdoor Unit 100)

The outdoor unit 100 includes the compressor 101, the flow switching device 102, the outdoor heat exchanger 103, and the expansion valve 105. The compressor 101 compresses and discharges the suctioned refrigerant. The compressor 101 may include an inverter device, and may be formed to be able to change the capacity of the compressor 101 by changing the operating frequency by the inverter device. Note that the capacity of the compressor 101 is the amount of the refrigerant sent out per unit time. The flow switching device 22 is a four-way valve, for example, and is a device in which the direction of the refrigerant flow passage is switched. The refrigeration cycle apparatus 50 can realize the heating operation or the cooling operation by switching the flow of the refrigerant with use of the flow switching device 102 on the basis of the instruction from a controller (not shown).

The outdoor heat exchanger 103 exchanges the heat between the refrigerant and the outdoor air. The outdoor heat exchanger 103 functions as an evaporator at the time of the heating operation, and exchanges the heat between low-pressure refrigerant flowing into the outdoor heat exchanger 103 from the refrigerant pipe 400 and the outdoor air, to thereby evaporate and gasify the refrigerant. The outdoor heat exchanger 103 functions as a condenser at the time of the cooling operation, and exchanges the heat between the refrigerant compressed in the compressor 101 flowing into the outdoor heat exchanger 103 from the flow switching device 102 side and the outdoor air, to thereby condense and liquefy the refrigerant. In the outdoor heat exchanger 103, an outdoor fan 104 is provided to increase the efficiency of the heat exchange between the refrigerant and the outdoor air. Regarding the outdoor fan 104, an inverter device may be mounted, and the rotation speed of the fan may be changed by changing the operating frequency of a fan motor. The expansion valve 105 is an expansion device (flow rate control unit), and functions as an expansion valve by adjusting the flow rate of the refrigerant flowing through the expansion valve 105. The expansion valve 105 adjusts the pressure of the refrigerant by changing the opening degree. For example, the expansion valve 105 adjusts the opening degree on the basis of the instruction from the controller (not shown) and other units when the expansion valve 105 is made of an electronic expansion valve or other valves.

(Indoor Unit 200)

The indoor unit 200 includes the indoor heat exchanger 201 configured to exchange the heat between the refrigerant and the indoor air, and an indoor fan 202 configured to adjust the flow of the air with which the indoor heat exchanger 201 performs heat exchange. The indoor heat exchanger 201 functions as a condenser at the time of the heating operation. The indoor heat exchanger 201 performs heat exchange between the refrigerant flowing into the indoor heat exchanger 201 from the refrigerant pipe 300 and the indoor air, condenses and liquefies the refrigerant, and causes the refrigerant to flow out to the refrigerant pipe 400 side. The indoor heat exchanger 201 functions as an evaporator at the time of the cooling operation. The indoor heat exchanger 201 performs heat exchange between the refrigerant placed in the low-pressure state by the expansion valve 105 and the indoor air, and causes the refrigerant to draw the heat from the air, so that the refrigerant is evaporated and vaporized. Then, the indoor heat exchanger 201 causes the refrigerant to flow out to the pipe 300 side. The indoor fan 202 is provided to face the indoor heat exchanger 201. The centrifugal fan 1 according to Embodiment 1 or 2 and the centrifugal fan 11 according to Embodiment 5 are applied to the indoor fan 202. The operation speed of the indoor fan 202 is determined by the setting by a user. An inverter device may be mounted on the indoor fan 202, and the rotation speed of the fan 2 may be changed by changing the operating frequency of the fan motor 6.

[Operation Example of Refrigeration Cycle Apparatus 50]

Next, an operation of the cooling operation is described as an operation example of the refrigeration cycle apparatus 50. High-temperature high-pressure gas refrigerant compressed by and discharged from the compressor 101 flows into the outdoor heat exchanger 103 via the flow switching device 102. The gas refrigerant flowing into the outdoor heat exchanger 103 is condensed by heat exchange with the outside air blown by the outdoor fan 104, is turned to be low-temperature refrigerant, and flows out from the outdoor heat exchanger 103. The expansion valve 105 expands the refrigerant flowing out of the outdoor heat exchanger 103 and reduces the pressure thereof. As a result, the refrigerant is turned to be low-temperature low-pressure two-phase gas-liquid refrigerant. The two-phase gas-liquid refrigerant flows into the indoor heat exchanger 201 of the indoor unit 200, and is evaporated by the heat exchange with the indoor air blown by the indoor fan 202. As a result, the two-phase gas-liquid refrigerant is turned to be low-temperature low-pressure gas refrigerant and flows out from the indoor heat exchanger 201. At this time, the heat of the indoor air is absorbed by the refrigerant and the indoor air cooled. As a result, the indoor air is turned to be conditioned air (blown air), and is blown out into the room (air-conditioned space) from the air outlet of the indoor unit 200. The gas refrigerant flowing out from the indoor heat exchanger 201 is suctioned by the compressor 101 via the flow switching device 102 and is compressed again. The operation above is repeated.

Next, an operation of the heating operation is described as an operation example of the refrigeration cycle apparatus 50. The high-temperature high-pressure gas refrigerant compressed by and discharged from the compressor 101 flows into the indoor heat exchanger 201 of the indoor unit 200 via the flow switching device 102. The gas refrigerant flowing into the indoor heat exchanger 201 is condensed by the heat exchange with the indoor air blown by the indoor fan 202, is turned to be low-temperature refrigerant, and flows out from the indoor heat exchanger 201. At this time, the indoor air heated by receiving heat from the gas refrigerant is turned to be conditioned air (blown air), and is blown out into the room (air-conditioned space) from the air outlet of the indoor unit 200. The expansion valve 105 expands the refrigerant flowing out from the indoor heat exchanger 201 and reduces the pressure of the refrigerant. As a result, the refrigerant is turned to be low-temperature low-pressure two-phase gas-liquid refrigerant. The two-phase gas-liquid refrigerant flows into the outdoor heat exchanger 103 of the outdoor unit 100, and is evaporated by the heat exchange with the outside air blown by the outdoor fan 104. As a result, the two-phase gas-liquid refrigerant is turned to be low-temperature low-pressure gas refrigerant and flows out from the outdoor heat exchanger 103. The gas refrigerant flowing out from the outdoor heat exchanger 103 is suctioned by the compressor 101 via the flow switching device 102, and is compressed again. The operation above is repeated.

The refrigeration cycle apparatus 50 according to Embodiment 5 includes the centrifugal fan 1 according to Embodiment 1 or 2, and hence can efficiently recover the pressure, and can improve the air-sending efficiency and reduce the noise.

The configurations described in the embodiments given above describe one example of the content of the present disclosure, and can be combined with other well-known technologies. Further, a part of the configuration can be omitted or changed without departing from the gist of the present disclosure.

REFERENCE SIGNS LIST

1 centrifugal fan 2 fan 2*a* main plate 2*a*1 circumferential portion 2*b* boss portion 2*c* side plate 2*d* blade 2*e* suction port 3 bell mouth 3*a* upstream end 3*b* downstream end 4 scroll casing 4*a* side wall 4*b* tongue portion 4*c* circumferential wall 4*d* protruding portion 5 suction port 6 fan motor 6*a* output shaft 7 case 9 fan motor 9*a* motor support 10 heat exchanger 11 centrifugal fan 16 case 16*a* upper surface portion 16 fan surface portion 16*c* side surface portion 17 case discharge port 18 case suction port 19 partition plate 22 flow switching device 30 air-sending device 40 air-conditioning apparatus 41 scroll portion 41*a* first end 41*b* second end 42 discharge portion

42*a* discharge port 50 refrigeration cycle apparatus 51 first extended portion 52 second extended portion 53 third extended portion 54 fourth extended portion 71 suction port 72 discharge port 73 partition plate 100 outdoor unit 101 compressor 102 flow switching device 103 outdoor heat exchanger 104 outdoor fan 105 expansion valve 200 indoor unit 201 indoor heat exchanger 202 indoor fan 300 refrigerant pipe

400 refrigerant pipe

The invention claimed is:

1. A centrifugal fan, comprising:

a fan including a main plate having a disk-shape, and a plurality of blades installed on a circumferential portion of the main plate; and a scroll casing configured to house the fan, the scroll casing including a discharge portion forming a discharge port from which an air flow generated by the fan is discharged, and a scroll portion including a side wall covering the fan in an axis direction of a rotational shaft of the fan, and provided with a suction port configured to suction air, a circumferential wall encircling the fan in a radial direction of the rotational shaft, and a tongue portion provided between the discharge portion and the circumferential wall, and configured to guide the air flow generated by the fan to the discharge port, wherein in the circumferential wall, a first end is a boundary between the circumferential wall and the tongue portion and a second end is a boundary between the circumferential wall and the discharge portion, a distance L1 is a distance between an axis of the rotational shaft and the circumferential wall, a distance L2 is a distance between the axis of the rotational shaft and a standard circumferential shape, the standard circumferential shape being one of a logarithmic spiral shape, an Archimedes' screw shape, or an involute curve shape, the standard circumferential shape being defined by a predetermined extension rate in a cross-section perpendicular to the rotational shaft of the fan, the distance L1 is equal to the distance L2 at the first end and the second end of the circumferential wall, the distance L1 is greater than or equal to the distance L2 between the first end and the second end of the circumferential wall, the circumferential wall includes a plurality of extended portions between the first end and the second end of the circumferential wall, the plurality of extended portions comprising a plurality of maximum points each having a length being a difference LH between the distance L1 and the distance L2, an angle θ is an angle shifted from a first reference line in a direction of rotation of the fan between the first reference line and a second reference line in cross-section perpendicular to the rotational shaft of the fan, the first reference line defined between the axis of the rotational shaft and the first end, the second reference line defined between the axis of the rotational shaft and the second end, an angle α is an angle between the first reference line and the second reference line in the direction of rotation of the fan, the plurality of extended portions include:

two extended portions in a section in which the angle θ is 90 degrees or more and less than the angle α; and the distance L1 is greater than the distance L2 over an entirety of the circumferential wall from one of the two extended portions to the other of the two extended portions.

2. The centrifugal fan of claim 1, wherein, the two extended portions include:

one of the plurality of maximum points in a section in which the angle θ is 90 degrees or more and less than 180 degrees; and an other of the plurality of maximum points in a section in which the angle θ is 180 degrees or more and less than the angle α.

3. The centrifugal fan of claim 1, wherein:

the plurality of extended portions include:

the two extended portions and an other extended portion, the two extended portions and the other extended portion include a first extended portion including a first maximum point P1 of the plurality of maximum points in the section in which the angle θ is 0 degrees or more and less than 90 degrees;

a second extended portion including a second maximum point P2 of the plurality of maximum points in the section in which the angle θ is 90 degrees or more and less than 180 degrees; and a third extended portion including a third maximum point P3 of the plurality of maximum points in the section in which the angle θ is 180 degrees or more and less than an angle α formed by the second reference line;

when a point at which the difference LH is smallest in a section in which the angle θ is 0 degrees or more and equal to or less than an angle at which the first maximum point P1 is positioned is a first minimum point U1;

a point at which the difference LH is smallest in a section in which the angle θ is 90 degrees or more and equal to or less than an angle at which the second maximum point P2 is positioned is a second minimum point U2;

a point at which the difference LH is smallest in a section in which the angle θ is 180 degrees or more and equal to or less than an angle at which the third maximum point P3 is positioned is a third minimum point U3;

a difference L11 between the distance L1 at the first maximum point P1 and the distance L1 at the first minimum point U1 relative to an increase θ1 of the angle θ from the first minimum point U1 to the first maximum point P1 is an extension rate A;

a difference L22 between the distance L1 at the second maximum point P2 and the distance L1 at the second minimum point U2 relative to an increase θ2 of the angle θ from the second minimum point U2 to the second maximum point P2 is an extension rate B; and a difference L33 between the distance L1 at the third maximum point P3 and the distance L1 at the third minimum point U3 relative to an increase θ3 of the angle θ from the third minimum point U3 to the third maximum point P3 is an extension rate C, a relationship of the extension rate B≥the extension rate A>the extension rate C, or a relationship of the extension rate B>the extension rate C≥the extension rate A is satisfied.

4. The centrifugal fan of claim 1, wherein:

the plurality of extended portions include:

the two extended portions and an other extended portion, the two extended portions and the other extended portion include a first extended portion including a first maximum point P1 of the plurality of maximum points in the section in which the angle θ is 0 degrees or more and less than 90 degrees;

a second extended portion including a second maximum point P2 of the plurality of maximum points in the section in which the angle θ is 90 degrees or more and less than 180 degrees; and a third extended portion including a third maximum point P3 of the plurality of maximum points in the section in which the angle θ is 180 degrees or more and less than an angle α formed by the second reference line;

when a point at which the difference LH is smallest in a section in which the angle θ is 0 degrees or more and equal to or less than an angle at which the first maximum point P1 is positioned is a first minimum point U1;

a point at which the difference LH is smallest in a section in which the angle θ is 90 degrees or more and equal to or less than an angle at which the second maximum point P2 is positioned is a second minimum point U2;

a point at which the difference LH is smallest in a section in which the angle θ is 180 degrees or more and equal to or less than an angle at which the third maximum point P3 is positioned is a third minimum point U3;

a difference L11 between the distance L1 at the first maximum point P1 and the distance L1 at the first minimum point U1 relative to an increase θ1 of the angle θ from the first minimum point U1 to the first maximum point P1 is an extension rate A;

a difference L22 between the distance L1 at the second maximum point P2 and the distance L1 at the second minimum point U2 relative to an increase θ2 of the angle θ from the second minimum point U2 to the second maximum point P2 is an extension rate B; and a difference L33 between the distance L1 at the third maximum point P3 and the distance L1 at the third minimum point U3 relative to an increase θ3 of the angle θ from the third minimum point U3 to the third maximum point P3 is an extension rate C, a relationship of the extension rate C>the extension rate B≥the extension rate A is satisfied.

5. The centrifugal fan of claim 1, wherein:

the plurality of extended portions include:

the two extended portions and an other extended portion, the two extended portions and the other extended portion include a first extended portion including a first maximum point P1 of the plurality of maximum points in the section in which the angle θ is 0 degrees or more and less than 90 degrees;

a second extended portion including a second maximum point P2 of the plurality of maximum points in the section in which the angle θ is 90 degrees or more and less than 180 degrees; and a third extended portion including a third maximum point P3 of the plurality of maximum points in the section in which the angle θ is 180 degrees or more and less than an angle α formed by the second reference line; and the distance L1 is greater than the distance L2 at a portion of the circumferential wall extending between the second extended portion and the third extended portion.

6. The centrifugal fan of claim 3, wherein, when:

a difference L44 between the distance L1 at the second minimum point U2 and the distance L1 at the first maximum point P1 relative to an increase θ11 of the angle θ from the first maximum point P1 to the second minimum point U2 is an extension rate D;

a difference L55 between the distance L1 at the third minimum point U3 and the distance L1 at the second maximum point P2 relative to an increase θ22 of the angle θ from the second maximum point P2 to the third minimum point U3 is an extension rate E;

a difference L66 between the distance L1 at the angle α and the L1 at the third maximum point P3 relative to an increase θ33 of the angle θ from the third maximum point P3 to the angle α is an extension rate F; and the distance L2 between the axis of the rotational shaft and the standard circumferential shape relative to the increase of the angle θ is an extension rate J, the extension rate J>the extension rate D≥0, the extension rate J>the extension rate E≥0, and the extension rate J>the extension rate F≥0 are satisfied.

7. The centrifugal fan of claim 1, wherein the circumferential wall bulges out in a direction perpendicular to the rotational shaft at a position facing the circumferential portion of the main plate, and, in a direction parallel to the rotational shaft, the distance L1 is greatest at a position of the circumferential wall facing the circumferential portion of the main plate.

8. The centrifugal fan of claim 1, wherein the circumferential wall has a protruding portion in a circumferential direction of the rotational shaft, the protruding portion protruding to the radial direction of the rotational shaft.

9. An air-sending device, comprising:

the centrifugal fan of claim 1; and a case configured to accommodate the centrifugal fan.

10. An air-conditioning apparatus, comprising:

the centrifugal fan of claim 1; and a heat exchanger disposed in a position facing the discharge port of the centrifugal fan.

11. A refrigeration cycle apparatus, comprising the centrifugal fan of claim 1.

* * * * *